US010260220B2

(12) United States Patent
Grover et al.

(10) Patent No.: US 10,260,220 B2
(45) Date of Patent: Apr. 16, 2019

(54) SANITARYWARE CLEANING SYSTEM

(71) Applicant: AS IP Holdco, LLC, Piscataway, NJ (US)

(72) Inventors: David Grover, Hamilton, NJ (US); Daigo Ishiyama, Summit, NJ (US); Tim Payne, Chicago, IL (US); Mark Kurth, La Porte, IN (US); Scott Rote, Mokena, IL (US); Phil Anthony, Chicago, IL (US); Aaron B. Eiger, Chicago, IL (US); Chris Helmstetter, Bridgewater, NJ (US)

(73) Assignee: AS IP HOLDCO, LLC, Piscataway, NJ (US)

( * ) Notice: Subject to any disclaimer, the term of this patent is extended or adjusted under 35 U.S.C. 154(b) by 308 days.

(21) Appl. No.: 14/723,003

(22) Filed: May 27, 2015

(65) Prior Publication Data

US 2015/0345123 A1 Dec. 3, 2015

Related U.S. Application Data

(60) Provisional application No. 62/003,222, filed on May 27, 2014.

(51) Int. Cl.

| | |
|---|---|
| ***E03D 9/03*** | (2006.01) |
| ***A47K 13/26*** | (2006.01) |
| *E03D 9/02* | (2006.01) |

(52) U.S. Cl.

CPC ..... *E03D 9/031* (2013.01); *A47K 13/26* (2013.01); *E03D 2009/024* (2013.01); *E03D 2009/028* (2013.01)

(58) Field of Classification Search

CPC .. E03D 9/03; E03D 9/031; E03D 9/02; E03D 9/022; E03D 2009/024; E03D 2009/026; E03D 2009/028; A47K 13/26

USPC ..... 4/226.1

See application file for complete search history.

(56) References Cited

U.S. PATENT DOCUMENTS

| | | | |
|---|---|---|---|
| 1,178,852 | A | 4/1916 | Grant |
| 1,211,137 | A | 1/1917 | Grant |
| 2,950,959 | A | 8/1960 | Ve Relle |
| 3,694,354 | A | 9/1972 | Nolte, Jr. |

(Continued)

FOREIGN PATENT DOCUMENTS

| | | |
|---|---|---|
| AU | 750000 B2 | 7/2002 |
| BR | 1005206 A2 | 12/2010 |

(Continued)

OTHER PUBLICATIONS

Fluidmaster, Flush n' Sparkle, Apr. 29, 2015, 4 pages, http://www.fluidmaster.com/blog/flush-n-sparkle.

(Continued)

*Primary Examiner* — Tuan N Nguyen

(74) *Attorney, Agent, or Firm* — Michele V. Frank; Venable LLP

(57) ABSTRACT

A sanitaryware cleaning system can include a sanitary fixture such as a toilet having a compartment formed on and under its deck. The compartment can house a cleaning tablet that is maintained within a waterway between a tank and a bowl of the sanitary fixture. When the fixture is operated, water flowing down the waterway can dissolve a portion of the cleaning tablet, thus injecting cleaning agents into the bowl along with the water.

21 Claims, 21 Drawing Sheets

(56) References Cited

U.S. PATENT DOCUMENTS

| | | | |
|---|---|---|---|
| 3,768,104 | A | 10/1973 | Sanderson |
| 3,867,101 | A | 2/1975 | Herring |
| 3,943,243 | A | 3/1976 | Kook et al. |
| 3,946,448 | A | 3/1976 | Sioufy |
| 4,117,560 | A | 10/1978 | Kidon et al. |
| 4,216,027 | A | 8/1980 | Wages |
| 4,229,410 | A | 10/1980 | Kosti |
| 4,382,304 | A | 5/1983 | Lehmann et al. |
| 4,432,102 | A | 2/1984 | Woodruff et al. |
| 4,450,594 | A | 5/1984 | Hotchkin et al. |
| 4,557,926 | A | 12/1985 | Nelson et al. |
| 4,561,130 | A | 12/1985 | Bumgardner et al. |
| 4,597,941 | A | 7/1986 | Bottom et al. |
| 4,654,341 | A | 3/1987 | Nelson et al. |
| 4,668,475 | A | 5/1987 | Meloy et al. |
| 4,707,866 | A | 11/1987 | Von Philipp et al. |
| 4,709,423 | A | 12/1987 | Richards et al. |
| 4,745,638 | A | 5/1988 | Richards et al. |
| 4,800,066 | A | 1/1989 | Sinclair et al. |
| 4,915,260 | A | 4/1990 | Jones et al. |
| 5,603,126 | A | 2/1997 | Scoggins |
| 5,689,837 | A | 11/1997 | Katona |
| 5,759,574 | A | 6/1998 | Bothe |
| 5,778,459 | A | 7/1998 | Guerin |
| 5,881,396 | A | 3/1999 | Rivera et al. |
| 5,910,475 | A | 6/1999 | Neumiller et al. |
| 5,924,142 | A | 7/1999 | Wang |
| 5,987,655 | A | 11/1999 | Smet et al. |
| 6,000,067 | A | 12/1999 | Cascia |
| 6,055,679 | A | 5/2000 | Goelz et al. |
| 6,124,251 | A | 9/2000 | Rader et al. |
| 6,151,722 | A | 11/2000 | Lubrano |
| 6,211,128 | B1 | 4/2001 | Black |
| 6,247,189 | B1 | 6/2001 | Dean et al. |
| 6,321,392 | B1 | 11/2001 | Sim |
| 6,339,850 | B1 | 1/2002 | Gore |
| 6,341,385 | B1 | 1/2002 | Downes |
| 6,440,915 | B2 | 8/2002 | Rader et al. |
| 6,447,722 | B1 | 9/2002 | Rakestraw |
| 6,449,779 | B1 | 9/2002 | Nguyen |
| 6,651,260 | B1 | 11/2003 | Dodson |
| 6,662,379 | B2 | 12/2003 | Nguyen et al. |
| 6,713,441 | B1 | 3/2004 | DeSenna et al. |
| 6,790,353 | B2 | 9/2004 | Connelly, Jr. |
| 6,833,340 | B2 | 12/2004 | Lefenfeld et al. |
| 7,007,312 | B1 | 3/2006 | Sim |
| 7,073,209 | B1 | 7/2006 | McCormick |
| 7,234,175 | B2 | 6/2007 | Wilson et al. |
| 7,563,756 | B2 | 7/2009 | Brady |
| 7,721,358 | B2 | 5/2010 | Park et al. |
| 7,934,271 | B2 | 5/2011 | Soller et al. |
| 8,095,997 | B2 | 1/2012 | Harris |
| 8,209,788 | B2 | 7/2012 | Takamine et al. |
| 8,266,728 | B2 | 9/2012 | Bulala et al. |
| 8,307,467 | B2 | 11/2012 | Bulala et al. |
| 8,316,475 | B2 | 11/2012 | Grover |
| 8,484,791 | B2 | 7/2013 | Lin |
| 8,631,518 | B1 | 1/2014 | Jennings |
| 8,631,519 | B1 | 1/2014 | Belliard et al. |
| 8,719,971 | B2 | 5/2014 | Burt et al. |
| 8,806,668 | B2 | 8/2014 | Lin et al. |
| 8,925,119 | B2 | 1/2015 | Burt |
| 2002/0061831 | A1 | 5/2002 | Kaziska et al. |
| 2003/0075205 | A1 | 4/2003 | Roberson |
| 2004/0040074 | A1 | 3/2004 | Leonard et al. |
| 2004/0099562 | A1 | 5/2004 | Vazquez |
| 2004/0128750 | A1 | 7/2004 | Cramer |
| 2005/0204459 | A1 | 9/2005 | Selenke |
| 2005/0247725 | A1 | 11/2005 | Smith |
| 2006/0130221 | A1 | 6/2006 | Bulala et al. |
| 2006/0137081 | A1 | 6/2006 | Ferrara et al. |
| 2006/0242754 | A1 | 11/2006 | Coppock |
| 2007/0039087 | A1 | 2/2007 | Bringmann |
| 2007/0214555 | A1 | 9/2007 | Ferrara et al. |
| 2007/0256226 | A1 | 11/2007 | Pinizzotto |
| 2007/0289054 | A1 | 12/2007 | Han et al. |
| 2008/0028505 | A1 | 2/2008 | Penn |
| 2009/0217447 | A1 | 9/2009 | Matsushita et al. |
| 2009/0241247 | A1 | 10/2009 | Thurin et al. |
| 2009/0265842 | A1 | 10/2009 | Higgins et al. |
| 2010/0180365 | A1 | 7/2010 | Shasho |
| 2013/0298320 | A1 | 11/2013 | Duncan |
| 2013/0305445 | A1 | 11/2013 | Stammel et al. |
| 2015/0013058 | A1 | 1/2015 | Bucher et al. |
| 2015/0074888 | A1 | 3/2015 | Coulter et al. |
| 2015/0345123 | A1 | 12/2015 | Grover et al. |

FOREIGN PATENT DOCUMENTS

| | | | | |
|---|---|---|---|---|
| CN | 102899197 | B | 6/2014 | |
| DE | 2460109 | A1 | 6/1976 | |
| DE | 3805561 | A1 | 8/1989 | |
| DE | 29714817 | U1 | 4/1998 | |
| DE | 10246866 | A1 | 4/2004 | |
| EP | 0070720 | B1 | 10/1986 | |
| EP | 1046756 | A1 | 10/2000 | |
| EP | 1426505 | A3 | 4/2005 | |
| EP | 1533427 | A1 | 5/2005 | |
| EP | 1561870 | A1 | 8/2005 | |
| EP | 1087067 | B1 | 10/2005 | |
| EP | 1640517 | A1 | 3/2006 | |
| EP | 2620489 | A1 | 7/2013 | |
| EP | 2620490 | A1 | 7/2013 | |
| EP | 2141221 | B1 | 10/2013 | |
| EP | 2775052 | A1 | 9/2014 | |
| EP | 2789754 | A3 | 3/2016 | |
| FR | 2572919 | A | 5/1986 | |
| FR | 2775995 | B1 | 9/2000 | |
| FR | 2808819 | A1 | 11/2001 | |
| FR | 2916772 | A1 | 12/2008 | |
| FR | 2970488 | A1 | 7/2012 | |
| GB | 190917085 | A * | 1/1910 | ..... E03D 9/031 |
| GB | 466414 | A | 5/1937 | |
| JP | 3-50677 | U | 5/1991 | |
| JP | 3015390 | U | 8/1995 | |
| JP | 2014055446 | A | 3/2014 | |
| WO | 199316242 | | 8/1993 | |
| WO | 1997017571 | | 5/1997 | |
| WO | 199316242 | | 8/1998 | |
| WO | 2001006067 | A2 | 1/2001 | |
| WO | 2007010311 | A1 | 1/2007 | |
| WO | 2008062364 | A1 | 5/2008 | |
| WO | 2008145962 | A1 | 12/2008 | |
| WO | 2010087700 | A2 | 8/2010 | |
| WO | 2015072848 | A1 | 5/2015 | |
| WO | 2015133976 | A1 | 9/2015 | |
| WO | 2016096369 | A1 | 6/2016 | |
| WO | 2016139493 | A1 | 9/2016 | |
| WO | 2016168881 | A1 | 10/2016 | |

OTHER PUBLICATIONS

International Search Report, International Patent Application No. PCT/US2015/32648, International Filing Date, May 27, 2015, dated Oct. 16, 2015.

Japanese Office Action dated Mar. 23, 2018 issued in corresponding Japanese Application No. 2016-568507 with English translation (8 pages).

Extended European Search Report dated Jun. 12, 2018 issued in corresponding European Application No. 15799038.3 (8 pages).

Colombian Office Action dated May 8, 2018 issued in corresponding Colombian Application No. NC2016/0005109 with English translation (10 pages).

International Search Report with Written Opinion dated Feb. 23, 2018 issued in corresponding International Application No. PCT/US2018/015297 (6 pages).

Chinese Office Action dated Jul. 23, 2018 issued in corresponding Chinese Application No. 201580026759.X (9 pages).

* cited by examiner

FIG. 14A
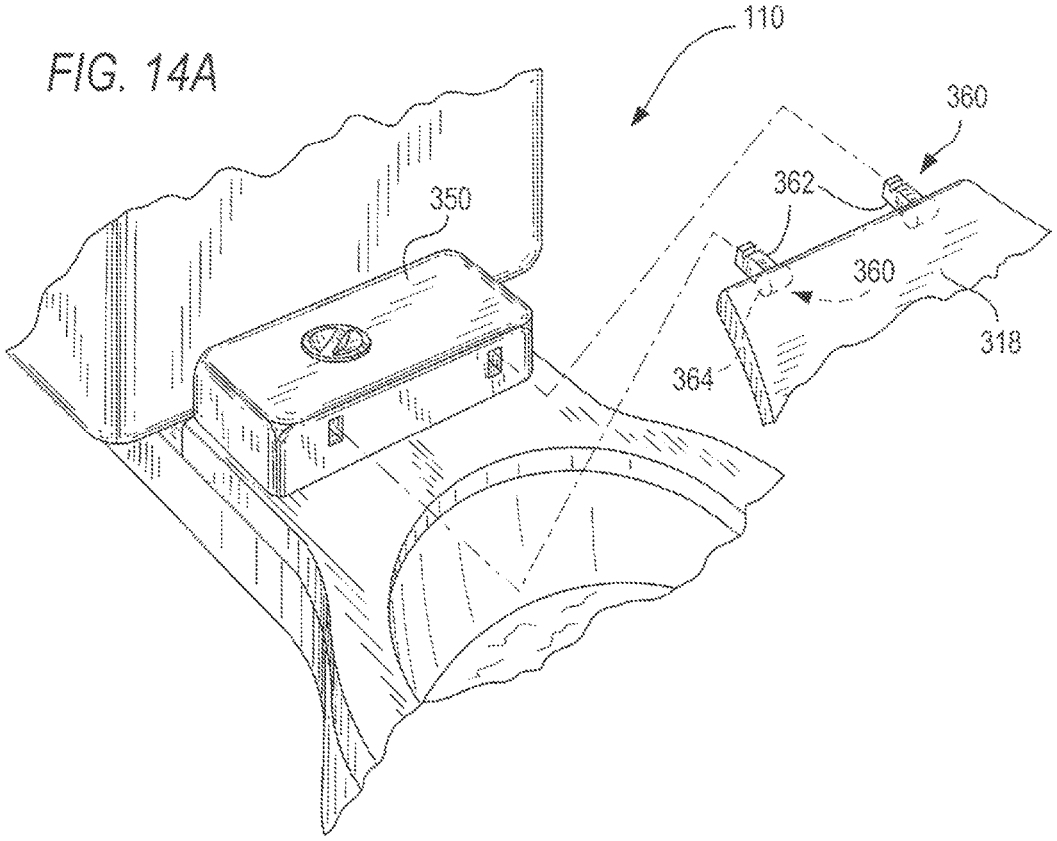
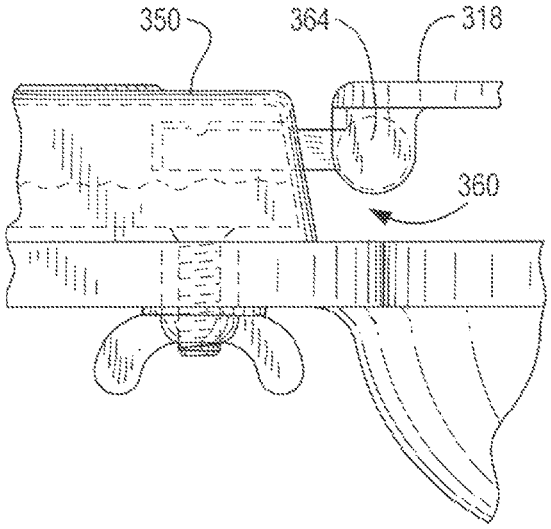
FIG. 14B

FIG. 17
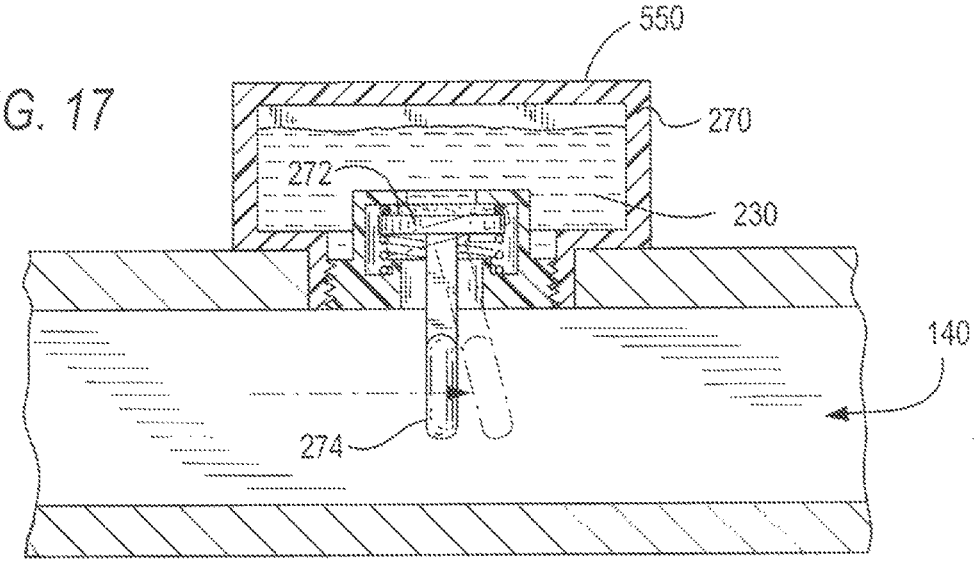
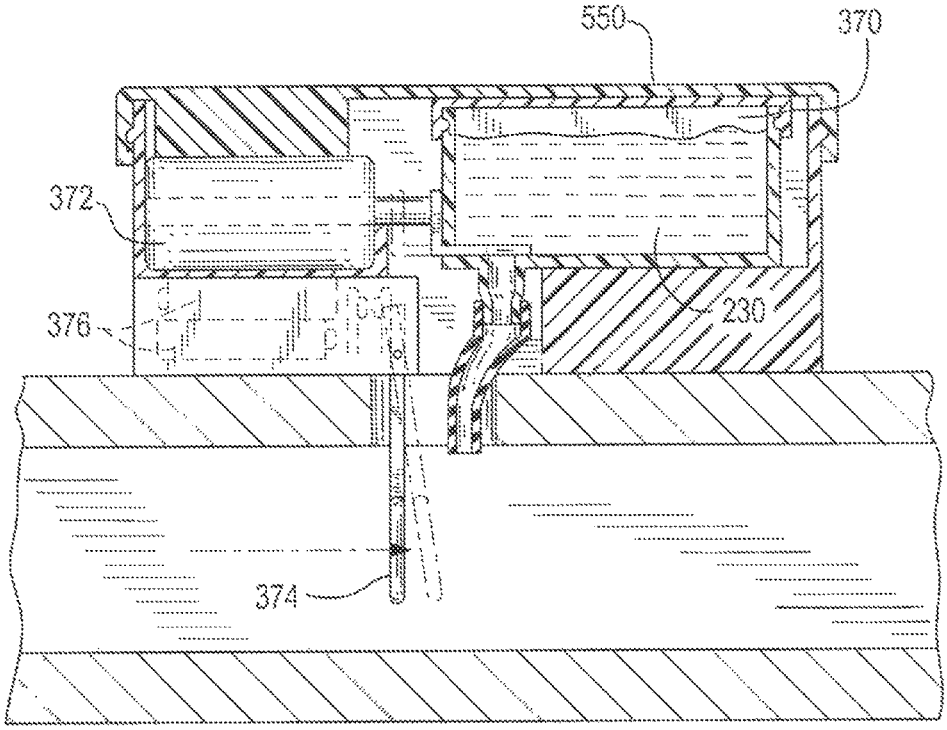
FIG. 18

FIG. 21A
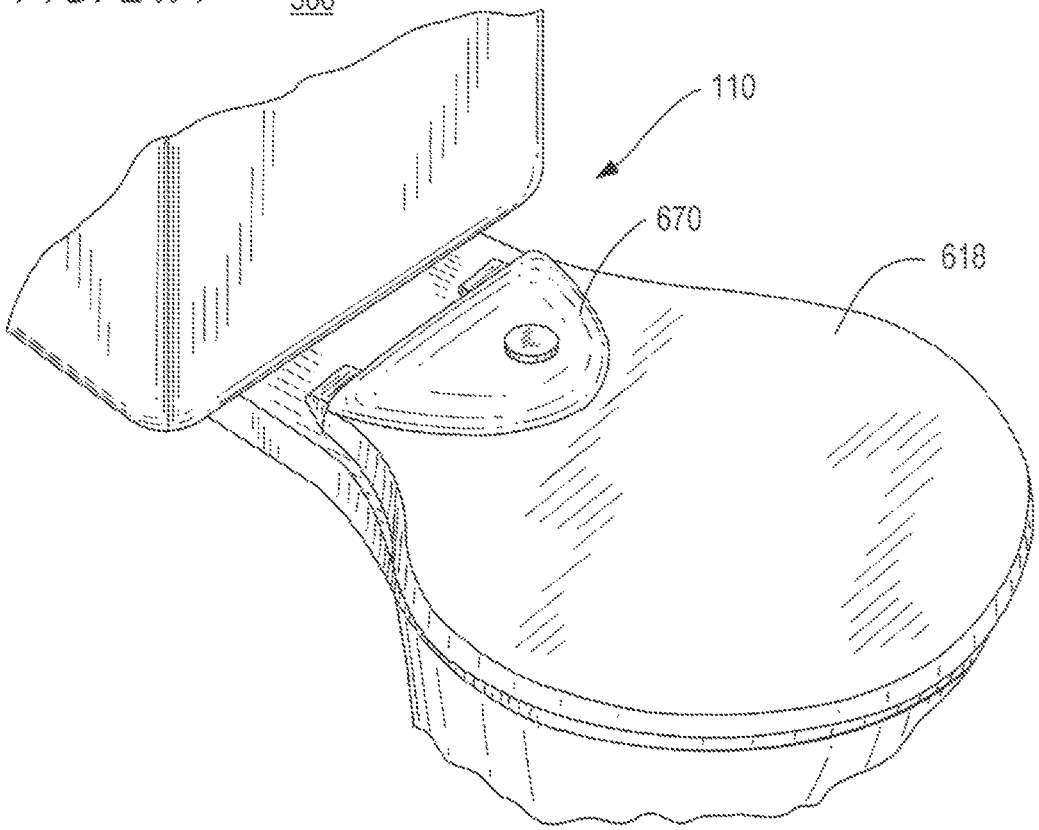
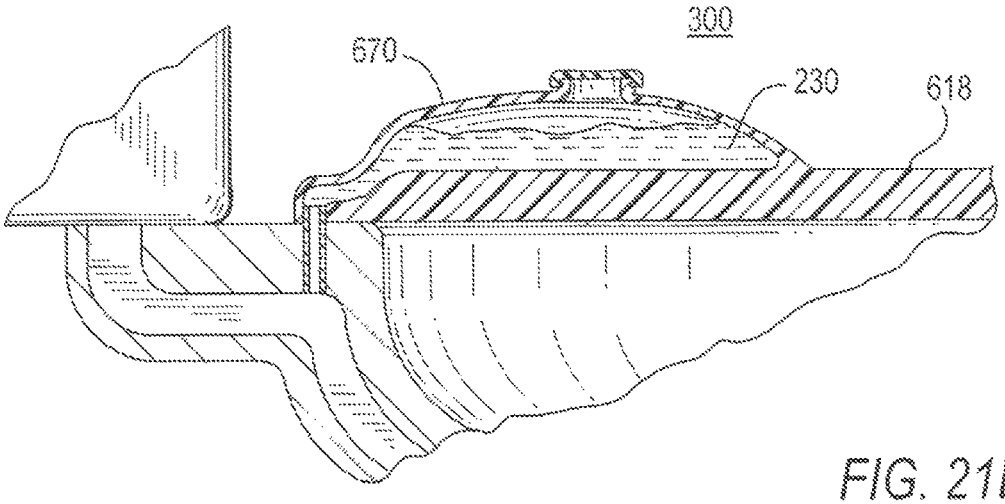
FIG. 21B

SANITARYWARE CLEANING SYSTEM

CROSS-REFERENCE TO RELATED APPLICATIONS

This application claims the benefit of U.S. Provisional Patent Application 62/003,222, entitled "SANITARYWARE CLEANING SYSTEM," filed May 27, 2014, the disclosure of which is incorporated by reference herein in its entirety.

FIELD OF THE INVENTION

The present invention generally relates to systems and methods for cleaning sanitary fixtures, such as toilets.

BACKGROUND OF THE INVENTION

Automatically dispensing disinfecting and deodorizing sanitaryware cleaning products are a boon to commercial and residential applications. These products can minimize the time and effort required to clean sanitary fixtures, such as for example toilets, by extending the time periods between manual cleanings, or eliminating the need for manual cleaning altogether, while keeping the fixtures and their environs tidy and fresh. Toilet cleaning products typically include a cleaning material formed into a water-soluble tablet. The tablet is then situated within either the toilet tank or toilet bowl such that when the toilet is flushed, some of the flushing water interacts with the tablet, dissolves some of the cleaning material, and dispenses the material into the toilet bowl.

Cleaning agents in the tablets can include chemicals that can degrade components of the toilet tank and toilet bowl and can be harmful upon direct contact with human skin. Situating the cleaning tablets in the tank or bowl, especially in locations that require a person to manually replace the tablets when they are spent, can therefore be undesirable. Toilet tank and toilet bowl placed cleaning products also put the unsightly tablets or tablet housings in plain view, detracting from otherwise clean, uninterrupted lines of the sanitary fixture and presenting a hazard to children and pets.

Flush toilets can be classified into three general categories depending on the design of the hydraulic channels used to achieve the flushing action: non-jetted, rim-jetted, and direct-jetted toilets. In non-jetted bowl designs, all of the flush water exits the tank into a bowl inlet area and flows through a primary manifold into the rim channel. The water can be dispersed around the perimeter of the bowl via a series of holes positioned underneath the rim. Although generally inferior to other designs with respect to flushing power and efficiency, non-jetted bowls are well suited for the invention described herein due to the fact that all of the dissolved cleaning fluid would be distributed around the rim of the bowl, achieving greater cleaning efficacy.

The bulk waste removal in toilets may be improved over non-jetted designs by incorporating "siphon jets." In a rim-jetted toilet bowl, the flush water exits the tank, flows through the manifold inlet area and through the primary manifold into the rim channel. A portion of the water is dispersed around the perimeter of the bowl via a series of holes positioned underneath the rim. The remaining water flows through a jet channel positioned at the front of the rim. This jet channel connects the rim channel to a jet opening positioned in the sump of the bowl, which is sized and positioned to send a powerful stream of water directly at the opening of the trapway.

In a direct-jetted bowl, the flush water exits the tank and flows through the bowl inlet and through the primary manifold. At this point, the water is divided into two portions: a portion that flows through a rim inlet port to the rim channel with the primary purpose of achieving the desired bowl cleansing, and a portion that flows through a jet inlet port to a "direct-jet channel" that connects the primary manifold to a jet opening in the sump of the toilet bowl (see for example, U.S. Pat. No. 8,316,475).

A new toilet has been described in U.S. Patent Application No. 61/810,664, "Primed Siphonic Flush Toilet," the disclosure of which is incorporated by reference herein in its entirety. This new toilet construction utilizes isolated rim and jet channels

SUMMARY OF THE INVENTION

Generally speaking, it is an object of the present invention to provide a sanitaryware cleaning system that avoids disadvantages of prior art constructions.

According to an embodiment of the present invention, a sanitary fixture, such as a toilet, may include a compartment between the toilet tank and the bowl for receiving and housing a cleaning product. The compartment may situate the cleaning product in the flow path at any point downstream of the flush valve and upstream of the outlet ports of the toilet rim such that, with every flush, water flowing past the cleaning injects cleaning material into the bowl via the rim outlet ports. In some embodiments, a perforated or slotted basket may hold the tablet within the compartment while simultaneously allowing water to flow from the tank, past the cleaning tablet, and into the toilet bowl. In alternative embodiments, the cleaning product may be tethered to a cap to permit the tablet to move freely in the water path with or without the use of a basket.

In some embodiments, a cap can cover the compartment with a water-tight fit to seal the system from leaks. The cap may further utilize a child-resistant design to prevent access by children and pets. The visible portion of the cap can be color-matched to the surface of the sanitary fixture or otherwise designed to be aesthetically pleasing and/or unobtrusive to the eye.

Still other objects and advantages of the present invention will in part be obvious and will in part be apparent from the specification.

The present invention accordingly comprises the features of construction, combinations of elements, and arrangement of parts, all as exemplified in the constructions herein set forth.

BRIEF DESCRIPTION OF THE DRAWINGS

For a fuller understanding of the inventive embodiments, reference is had to the following description taken in connection with the accompanying drawings in which:

FIGS. 14A and 14B show perspective and side elevation views, respectively, of another seat/cover mounted to a sanitary fixture with a hinge that includes arms and a pivot.

FIG. 17 shows a cross-sectional view of a seat-hinge cover housing a reservoir, in accordance with various embodiments of the present invention;

FIG. 18 shows a cross-sectional view of a seat-hinge cover housing another reservoir, in accordance with various embodiments of the present invention;

FIGS. 21A and 21B show perspective and cross-sectional views, respectively, of a sanitaryware cleaning system, in accordance with various embodiments of the present invention;

DETAILED DESCRIPTION OF THE PREFERRED EMBODIMENTS

Figure 1:
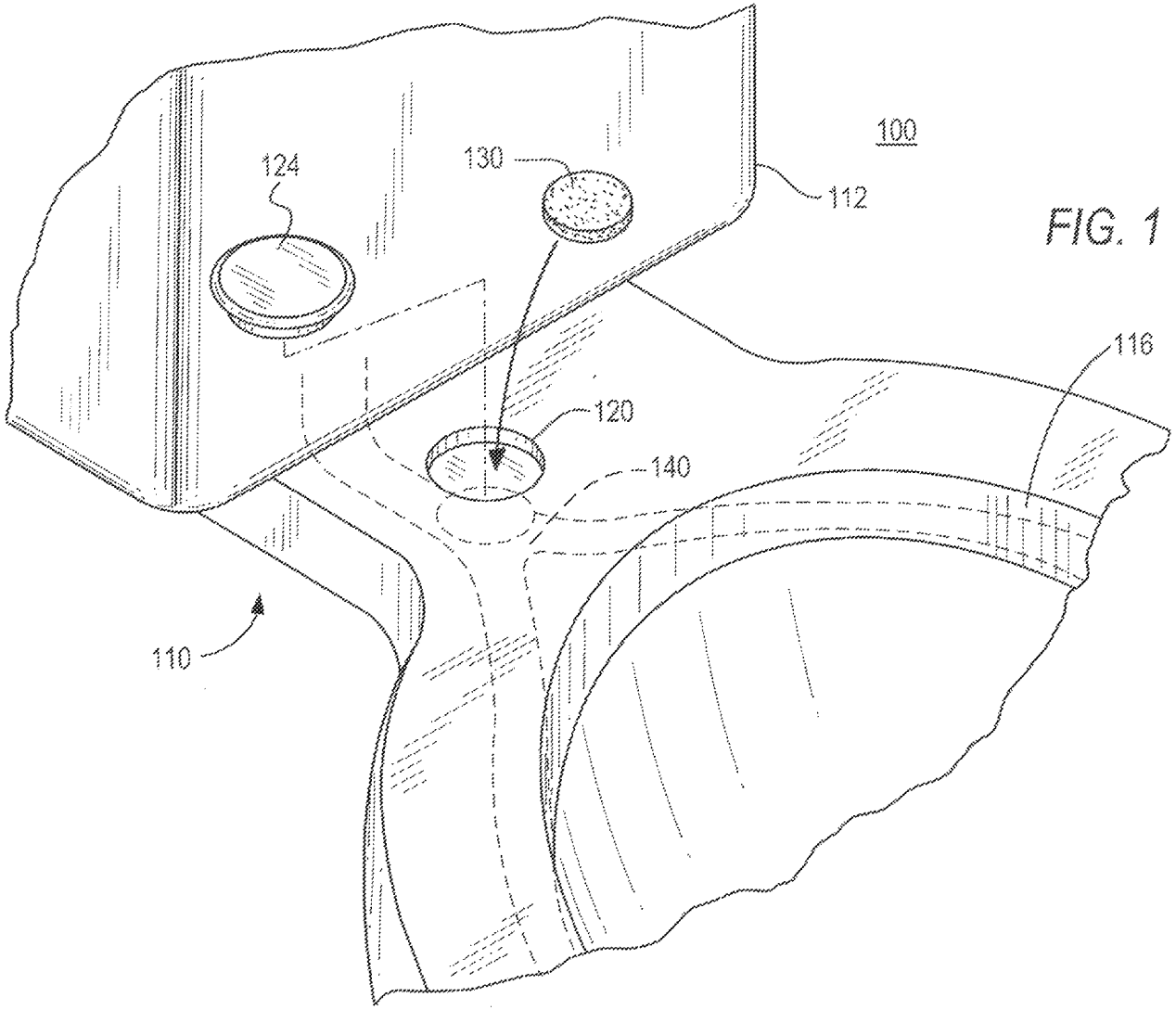
FIG. 1 shows a perspective view of a sanitaryware cleaning system, in accordance with various embodiments of the present invention.

FIG. 1 shows a perspective view of sanitaryware cleaning system 100, in accordance with various embodiments of the present invention. System 100 includes sanitary fixture 110, in this case, a toilet, having tank 112, deck 114, and bowl 116. While the sanitary fixture shown in FIG. 1 is a toilet, it should be appreciated that embodiments of the present invention have application in any sanitary fixture, such as a bidet, or a urinal, for example.

Sanitary fixture 110 can include compartment 120 for receiving and/or housing cleaning product 130, which may be used to clean, disinfect, and/or deodorize sanitary fixture 110. As shown in FIG. 1, cleaning product 130 may include one or more cleaning agents formed into a water-soluble solid product, such as a tablet, for example, that dissolves when contacted with water. It should be understood, however, that in other embodiments, cleaning agents may be incorporated into a liquid cleaning product.

During operation of sanitary fixture 110, a measured amount of water can flow past cleaning product 130, dissolving a portion of cleaning product 130 and injecting the cleaning agents into bowl 116. Any suitable cleaning product known in the art that fits within compartment 120 may be used with the embodiments described herein to introduce new cleaning agents into bowl 116 each time sanitary fixture 110 is operated or with some other frequency.

Compartment 120 may be sealed from the outside environment with cap 124. Cap 124 can provide a water-tight or water-resistant seal with compartment 120 to prevent leaks or spray into our out of compartment 120. O-rings 126*a* and 126*b* (shown in FIG. 3) may facilitate the desired water-tight fit. Cap 124 may be removably coupled to compartment 120 using any suitable coupling features, such as one or more threads, clips, clasps, or latches, for example. Cap 124 may also form a press-fit coupling with the edges of compartment 120. In some embodiments, cap 124 may use a child proof design, such as a squeeze-and-turn, push-down-and-turn, or a push-tab-and-turn threaded coupling. Child proofing compartment 120 may help to prevent children or pets from accessing tablet 130, which can contain potentially harmful ingredients. Cap 124 may be formed from any suitable plastic, metal, or composite material, or cap 124 may be formed from a ceramic material similar or identical to the ceramic material used to form the body of sanitary fixture 110.

Compartment 120 may be positioned at any location that provides access to the flush water channel(s) downstream of the flush valve and upstream of the rim outlet port(s). To minimize the potential for leaks, a preferable position is on/under deck 114 of sanitary fixture 110. That is, compartment 120 may include a hole in deck 114 that extends from its top surface and into waterway 140 below. The hole may be formed using any process suitable for working with sanitary fixtures, which are typically made of porcelain. For example, the hole may be formed when the sanitary fixture is molded or after the fixture is molded, and before or after the fixture is glazed and fired, using a punching or drilling process. Compartment 120 may be located at any location on and under deck 114 that provides easy access from the top for replacing tablet 130 and access to the flow of water between tank 112 and bowl 116.

In particular, compartment 120 may be located at least partially within waterway 140, which can run between tank 112 and one or more outlet ports near the rim of bowl 116. Depending on the particular construction of sanitary fixture 110, the number of rim outlet ports (e.g., 1, 5, 10, 20, etc.) provided near the rim may vary. Water flowing through waterway 140 and past compartment 120 may enter bowl 116 via some or all of the rim outlet ports provided.

Figure 2B:
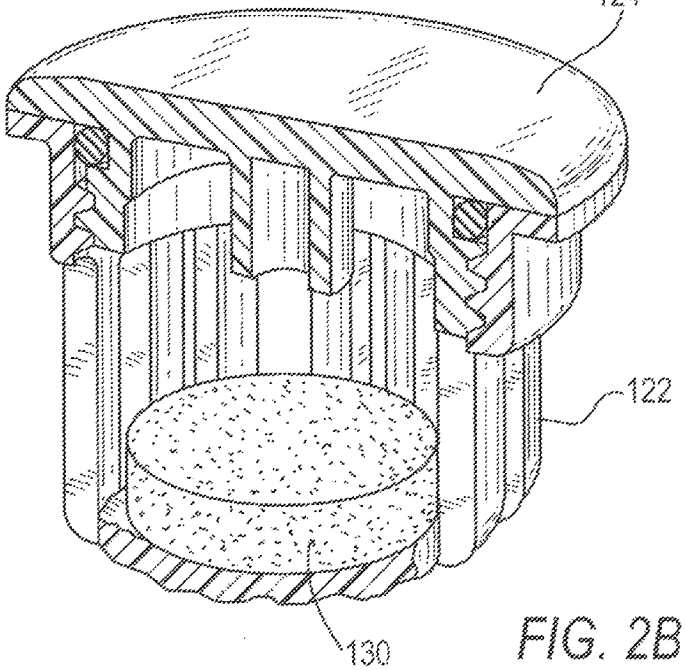
FIGS. 2A and 2B show perspective and cutaway views, respectively, of a basket, cap, and cleaning product, in accordance with various embodiments of the present invention.
Figure 2A:
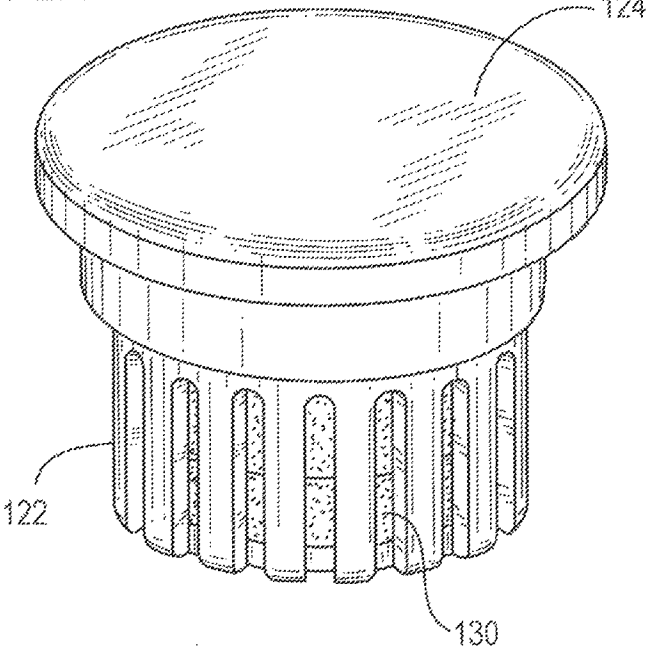

FIGS. 2A and 2B show perspective and cutaway views, respectively, of basket 122, cap 124, and cleaning product 130 in accordance with various embodiments. Basket 122 can be situated within compartment 120 and may include one or more slots, perforations, or orifices (generally referred to herein as apertures) to allow water to flow past cleaning product 130 while maintaining the cleaning product within the basket. Although cap 124 is depicted in FIGS. 2A and 2B as clipping onto grooved features formed on the internal surface of basket 122, cap 124 may be coupled to basket 122 and/or the compartment in which basket is housed using the various alternative methods described above as well as using other methods known in the art.

Figure 3:
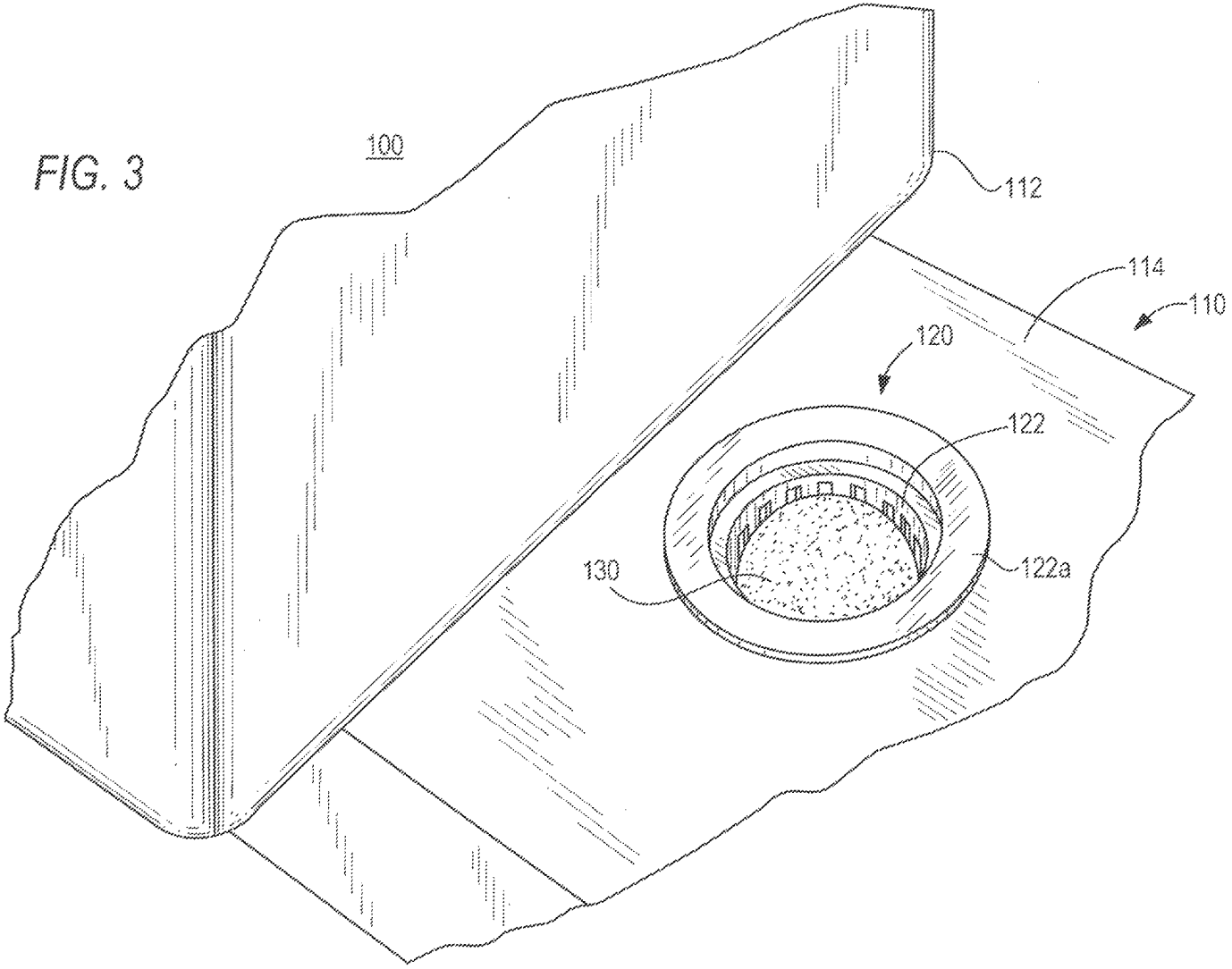
FIG. 3 shows a perspective view of sanitaryware cleaning system with a basket placed in a compartment 120, in accordance with various embodiments of the invention.

FIG. 3 shows a perspective view of sanitaryware cleaning system 100 with basket 122 placed in compartment 120, in accordance with various embodiments of the invention. According to some embodiments, basket 122 may be placed in compartment 120 to maintain cleaning product 130 at least partially in waterway 140 between tank 112 and bowl 116. Basket 122 can include one or more slots, perforations, or orifices to allow water to flow from tank 112, past tablet 130, and into bowl 116. Basket 122 may be formed from any suitable plastic, metal, or composite material. However, it may be advantageous to choose a material that is resistant to degradation with prolonged exposure to water and the chemicals bound up in cleaning product 130 to prolong its life and to avoid the need to replace basket 122 periodically. Basket 122 may be removable from compartment 120 if desired to clean the basket, replace the basket, access the waterway, and/or to facilitate replacement of tablet 130.

Figure 4:
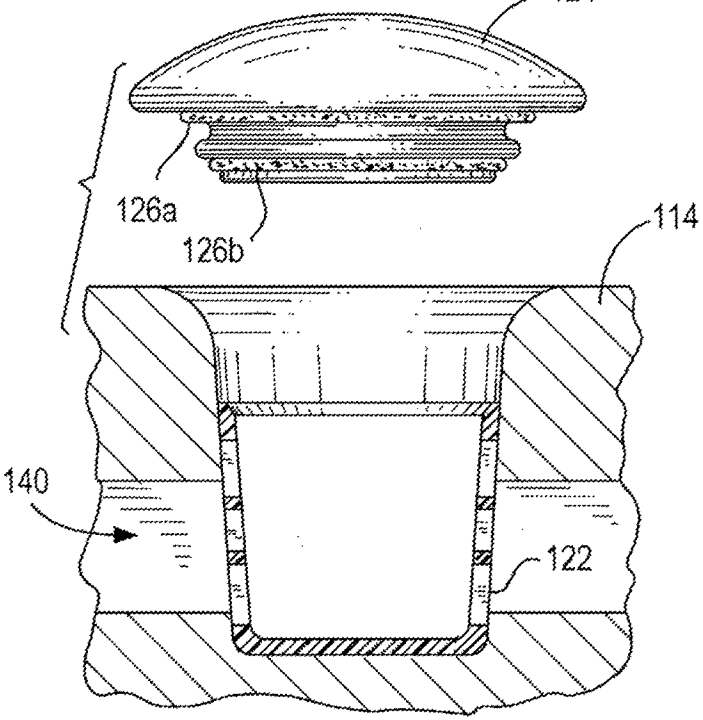
FIG. 4 shows a cross-sectional view of a basket situated in a compartment, in accordance with various embodiments of the invention.

FIG. 4 shows a cross-sectional view of basket 122 situated in compartment 120, in accordance with various embodiments of the invention. As depicted in FIG. 4, basket 122 can extend fully through waterway 140 to situate cleaning product 130 within the flow of water between tank 112 and bowl 116. In some embodiments, however, basket 122 may only extend partially into waterway 140. Generally speaking, the higher the surface area of cleaning product 130 contacted by fluid in waterway 140, the higher the volume of cleaning agents discharged into bowl 116. Thus, the rate at which cleaning agents are injected into bowl 116 may be varied by varying how far basket 122 extends into waterway 140, among other variables, such as the size of the slots, perforations, or orifices of basket 122.

As depicted in FIG. 4, basket 122 may sit fully within compartment 120. Alternatively, as depicted in FIG. 3, basket 122 may include lip 122*a* (integrally formed with basket 122 or otherwise coupled thereto) configured to rest atop or just below the surface of deck 114.

Figure 5:
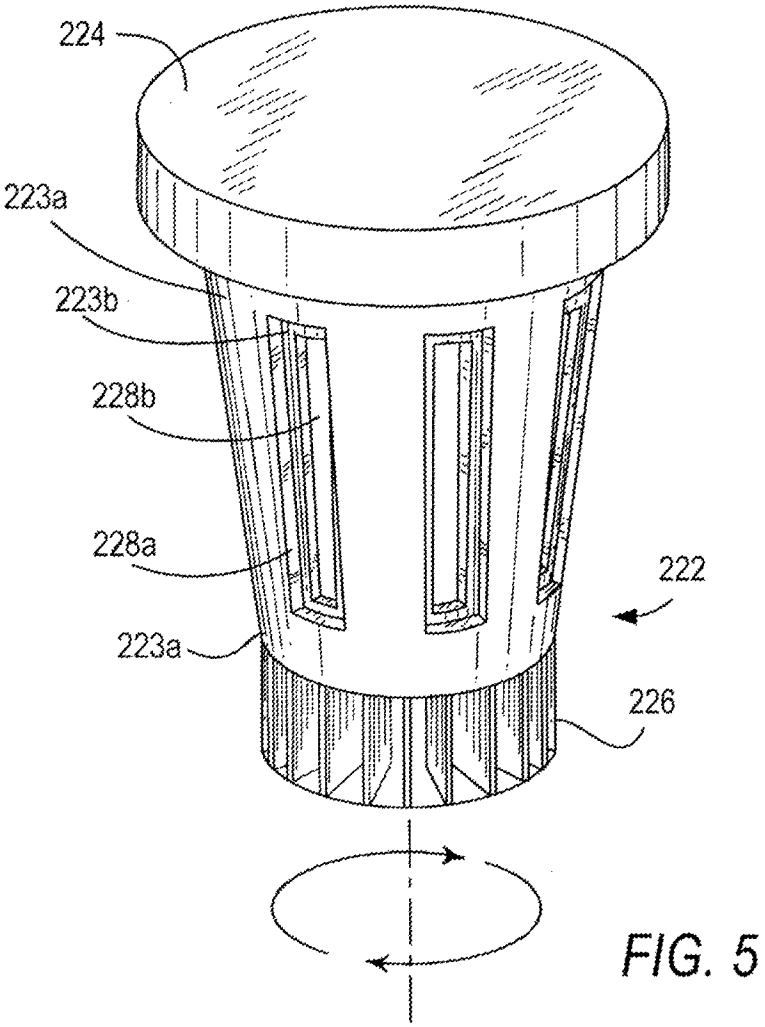
FIG. 5 shows a perspective view of another basket, in accordance with various embodiments of the invention.

FIG. 5 shows a perspective view of basket 222, in accordance with various embodiments of the invention. Basket 222 may be configured to inject cleaning agents into the bowl periodically (e.g., every 3, 5, or 10 flushes) as opposed to basket 122, which results in injection of cleaning agents every flush. In order to reduce the frequency at which cleaning agents are injected into the bowl, basket 222 can include outer shell 223*a* having slots 228*a* and inner shell 223*b* (visible through slots 228*a*) having slots 228*b*. When slots 228*a* and 228*b* are aligned, water flowing past basket 222 through the waterway (e.g., waterway 140) can contact a cleaning product (e.g., cleaning product 130) placed within the basket and inject cleaning agents into the bowl.

In order to periodically align slots 228*a* and 228*b*, basket 222 can include waterwheel 226, which may be coupled to one or the other of outer shell 223*a* and inner shell 223*b*. When fluid flows through the waterway past basket 222, waterwheel 226, and by extension either outer shell 223*a* or inner shell 223*b*, can rotate a certain amount as shown by the arrows depicted in FIG. 4. By rotating one of outer shell 223*a* and inner shell 223*b* with respect to the other, slots 228*a* and 228*b* can be periodically aligned (opened) and misaligned (closed) in order to provide a periodic injection of cleaning agents. The periodicity of injection may be varied by altering the distance waterwheel 226 rotates each flush as well as by altering the relative spacing between slots 228*a* and between slots 228*b*. The non-rotating shell, that is, the shell not coupled to waterwheel 226, may be coupled (e.g., via a press fit with or without O-rings, with a threaded connection, or with one or more clips or fasteners) to cap 224 to rotatably fix that shell in compartment 120.

Figure 6A:
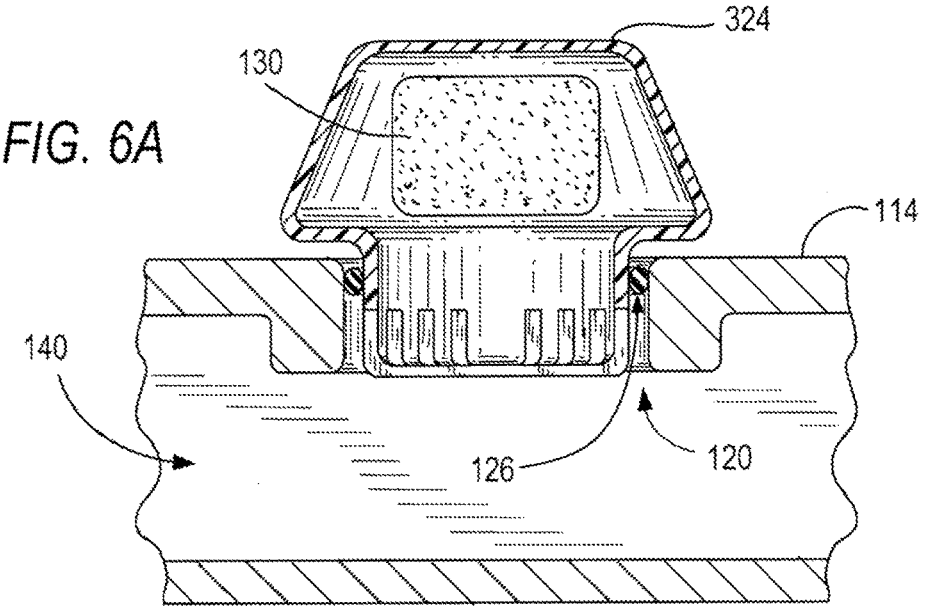
FIGS. 6A and 6B show a cross-sectional view of cleaning pucks situated in a compartment, in accordance with various embodiments of the invention.

FIG. 6 shows a cross-sectional view of cleaning puck 324 situated in compartment 120, in accordance with various embodiments of the invention. Cleaning puck 324 may combine aspects of a cap (e.g., cap 124 or 224) and a basket (e.g., basket 122 or 222) in a single component. Accordingly, cleaning puck 324 can include a hollow cavity to house cleaning product 130 and can be placed within compartment 120 of sanitary fixture 110. O-ring 126 may be provided around a perimeter of cleaning puck 324 configured to reside within compartment 120 in order to seal compartment 120 off from the environment outside of sanitary fixture 110. Cleaning puck 324 may be removably coupled to edges of compartment 120 using, for example, a press-fit or threaded coupling.

When fluid flows through waterway 140, some amount of fluid can enter into the hollow cavity of cleaning puck 324 to contact cleaning product 130 and carry cleaning agents into bowl 116. In some embodiments, cleaning puck 324 may be a consumable unit that is replaceably when cleaning product 130 is exhausted. In other embodiments, cleaning puck 324 may be designed to receive a new cleaning product when cleaning product 130 is exhausted.

Figure 6B:
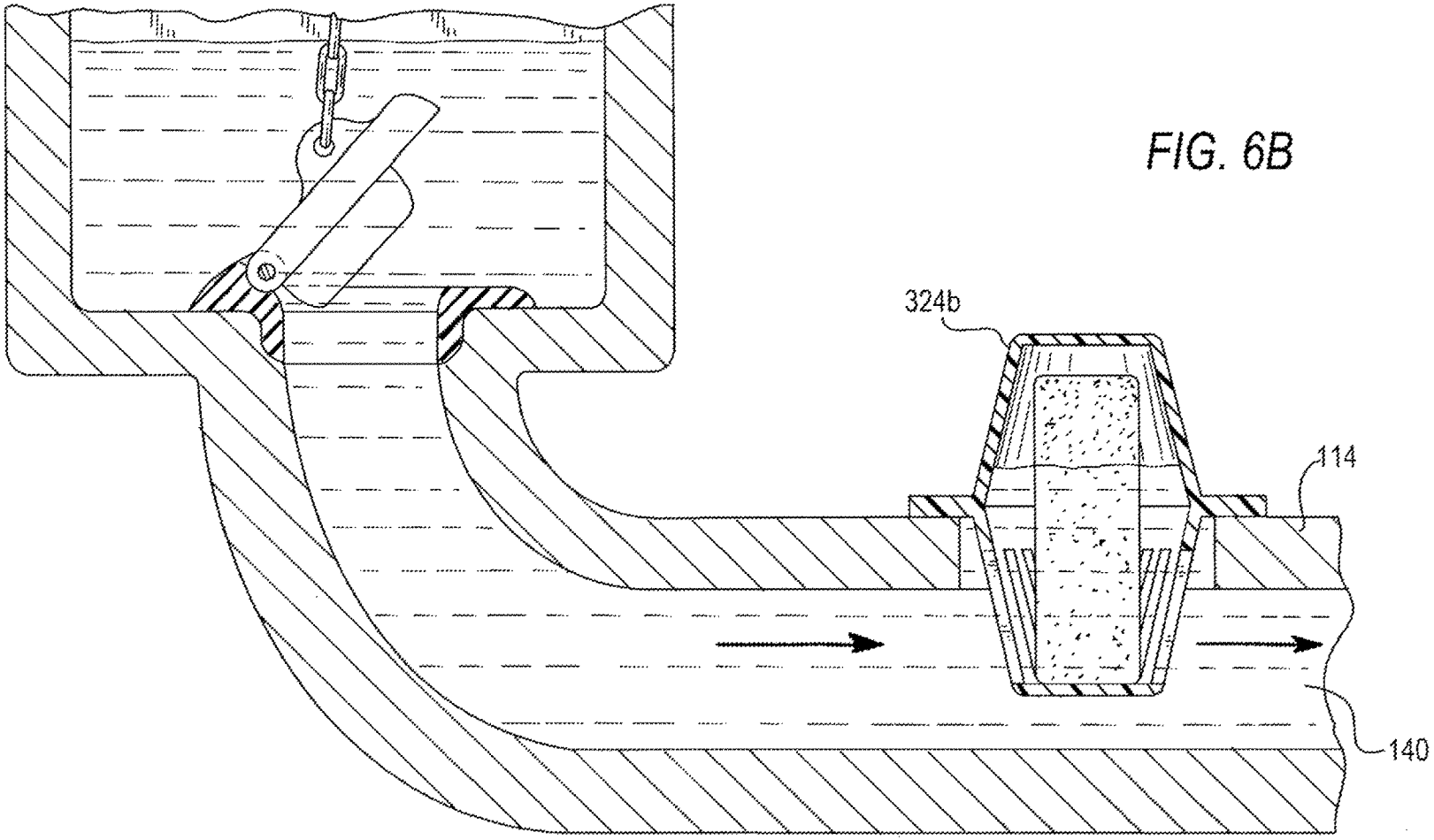

FIG. 6B shows a schematic cross-sectional view of an alternative cleaning puck 324*b*, in accordance with various embodiments of the present invention. Like cleaning puck 324, cleaning puck 324*b* can be provided as a single component that includes a hollow cavity to house cleaning product 130, which in this case is cylindrically-shaped and extends into waterway 140. As water erodes cleaning material 130, the force of gravity can cause the material to remain in waterway 140. Further, in contrast to cleaning puck 324, the section of cleaning puck 324*b* that extends above deck 114 can be sized and shaped to retain air compressed in waterway 140 when sanitary fixture 110 is flushed. This compressed-air chamber can help to ensure that water flowing down waterway 140 suitably interacts with cleaning product 130.

Figure 7:
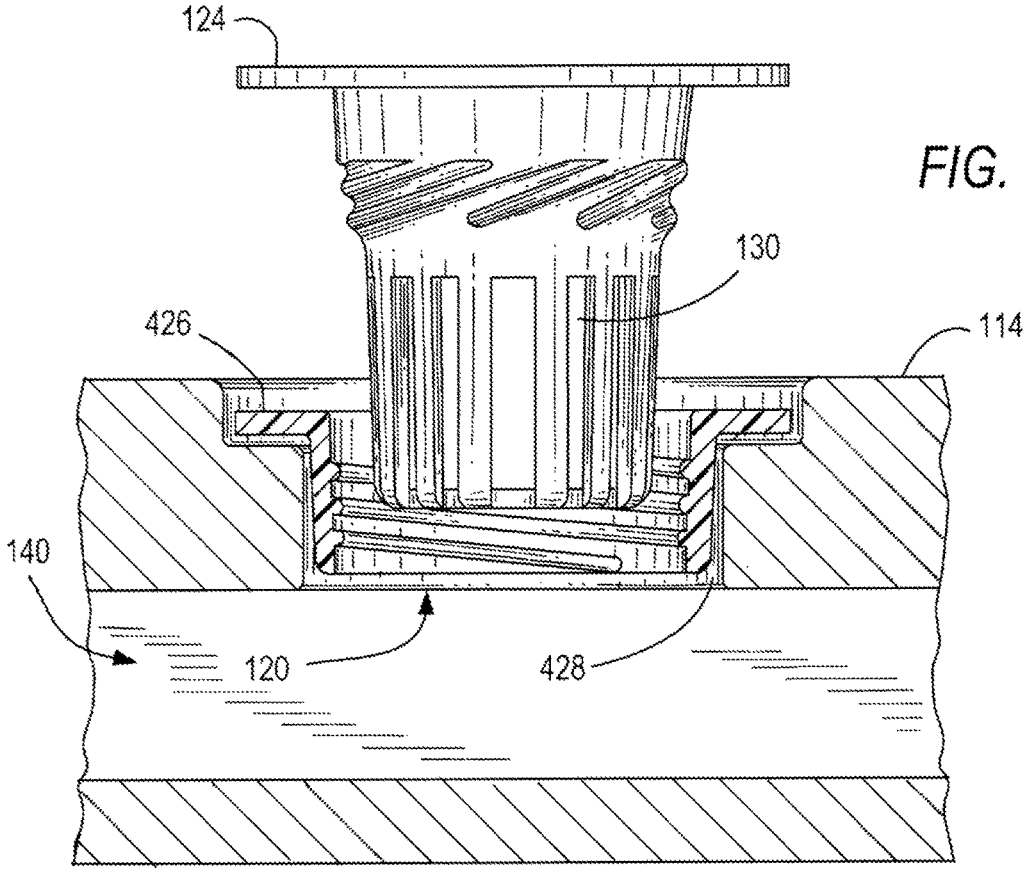
FIGS. 7 and 8 show cross-sectional and exploded views, respectively, of a cleaning cup for use in sanitary fixture, in accordance with various embodiments of the invention.
Figure 8:
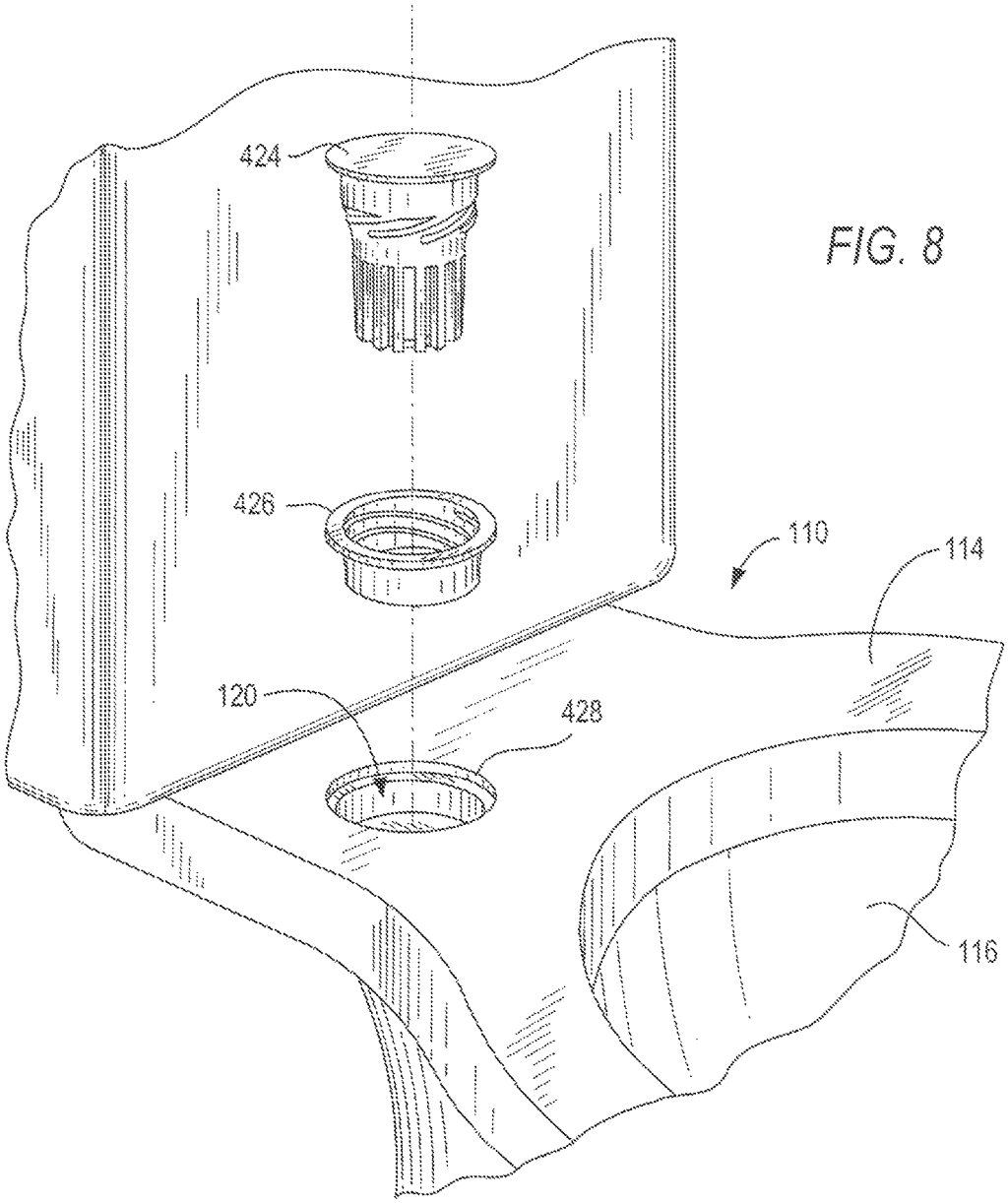

FIGS. 7 and 8 show a cross-sectional and exploded views, respectively, of a cleaning cup 424 for use in sanitary fixture 110, in accordance with various embodiments of the invention. Cleaning cup 424, like cleaning puck 324 can combine aspects of a cap (e.g., cap 124 or 224) and a basket (e.g., basket 122 or 222) in a single component. Cleaning cup 424 may be placed directly into compartment 120 of sanitary fixture 110 and can seal compartment off from the environment outside sanitary fixture 110 using a press-fit or threaded coupling with or without an O-ring. Cleaning cup 424 can include a hollow cavity to retain cleaning component 130 with slots permitting fluid communication into the hollow cavity such that when water flows through waterway 140, water contacts cleaning component 130 and carries cleaning agents into bowl 116.

In some embodiments, cleaning cup 424 may be configured to mate with sleeve 426, which may be formed from any suitable material, such as a plastic, metal, composite, or ceramic material. Sleeve 426 may include an interior annular perimeter with one or more coupling components formed thereon (e.g., threads complementary to thread formed on an outer annular perimeter of cleaning cup 424. In these embodiments, cleaning cup 424 may be provided with one or more sealing elements (e.g., O-rings) to seal off compartment 120. In other embodiments, sleeve 426 may be received within a sealing sleeve 428 designed to fit closely against the contours of the outer surfaces of compartment 120. Sealing sleeve 428 may be formed from a resilient material, such as silicone or rubber, for example.

Figure 9:
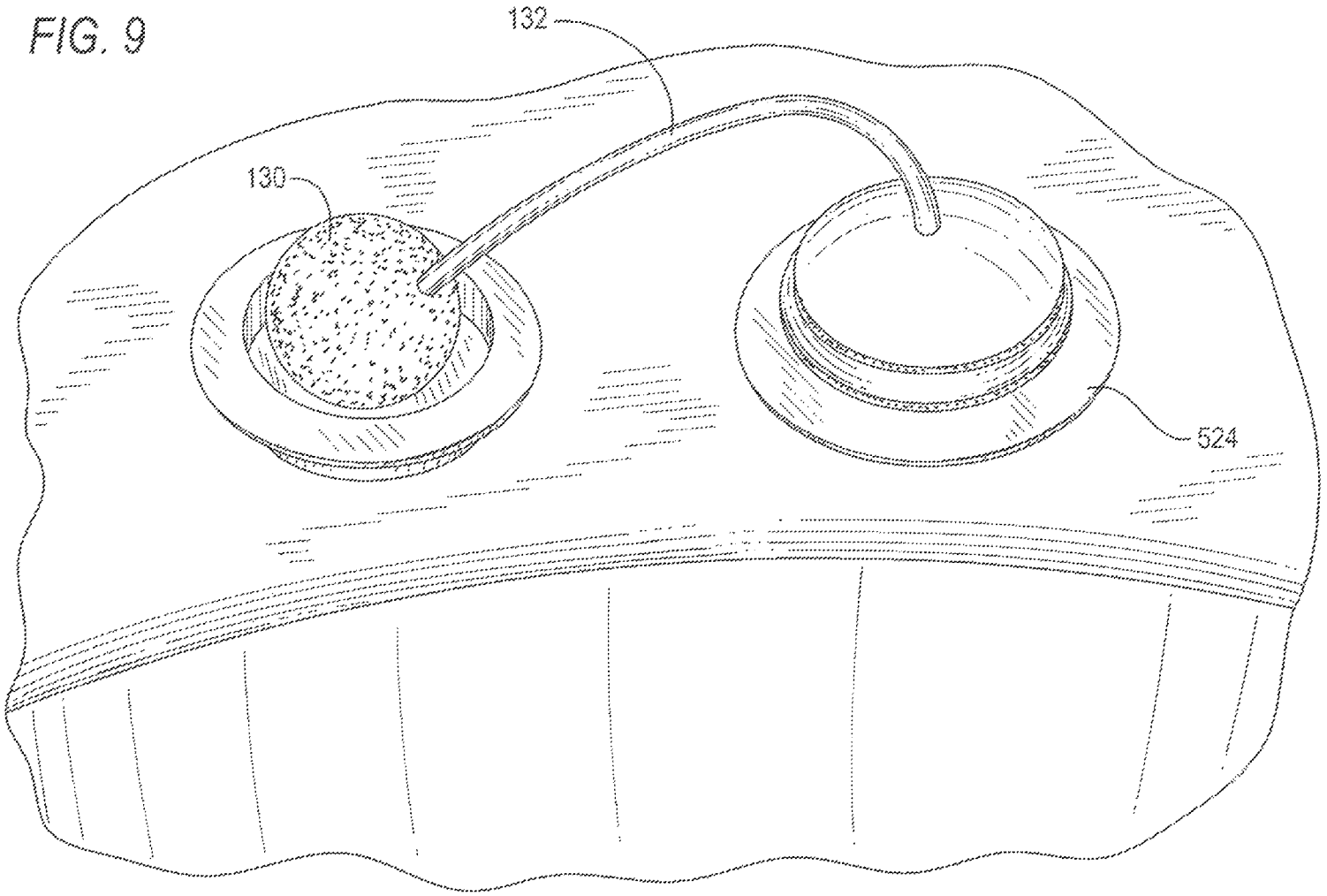
FIG. 9 shows a perspective view of a cleaning product tethered to a cap, in accordance with various embodiments.

FIG. 9 shows a perspective view of cleaning product 130 tethered to cap 524, in accordance with various embodiments. In these embodiments, cleaning product 130 may be provided with tether 132, which may be removably coupled to a feature of cap 524 (e.g., using a press-fit coupling, an adhesive, or the like). Cleaning product 130 may then be placed within compartment 120 of sanitary fixture 110. Tether 232 may permit cleaning product 130 to move freely in waterway 140 between tank 112 and the rim outlet ports to facilitate dissolution of the cleaning agent. The length of tether 132 may be optimized to prevent cleaning product 130 from having prolonged contact with any surfaces of sanitary fixture 110. Cap 524 may be removably coupled a feature of compartment 120 as described above.

In some embodiments, one or more elements of cleaning product 130, cap 524, and tether 132 may be part of a single consumable cleaning agent package, which could eliminate the need for ensuring long-term chemical compatibility of the elements, and could provide a less expensive and more reliable system.

The efficacy of a particular sanitaryware cleaning system may depend on many factors, including how much cleaning material is dispensed into the bowl, where the cleaning material is dispensed, and how much of the cleaning material is jetted directly through the trapway and out of the bowl without contacting a significant portion of the surface to be cleaned. These factors may all be influenced by the particular designs of the sanitaryware system. Cleaning sanitary fixture 110 using cleaning products dispensed through the rim outlets may be particularly effective when used in conjunction with a system that discharges all of the cleaning agents through the rim outlets.

Figure 10:
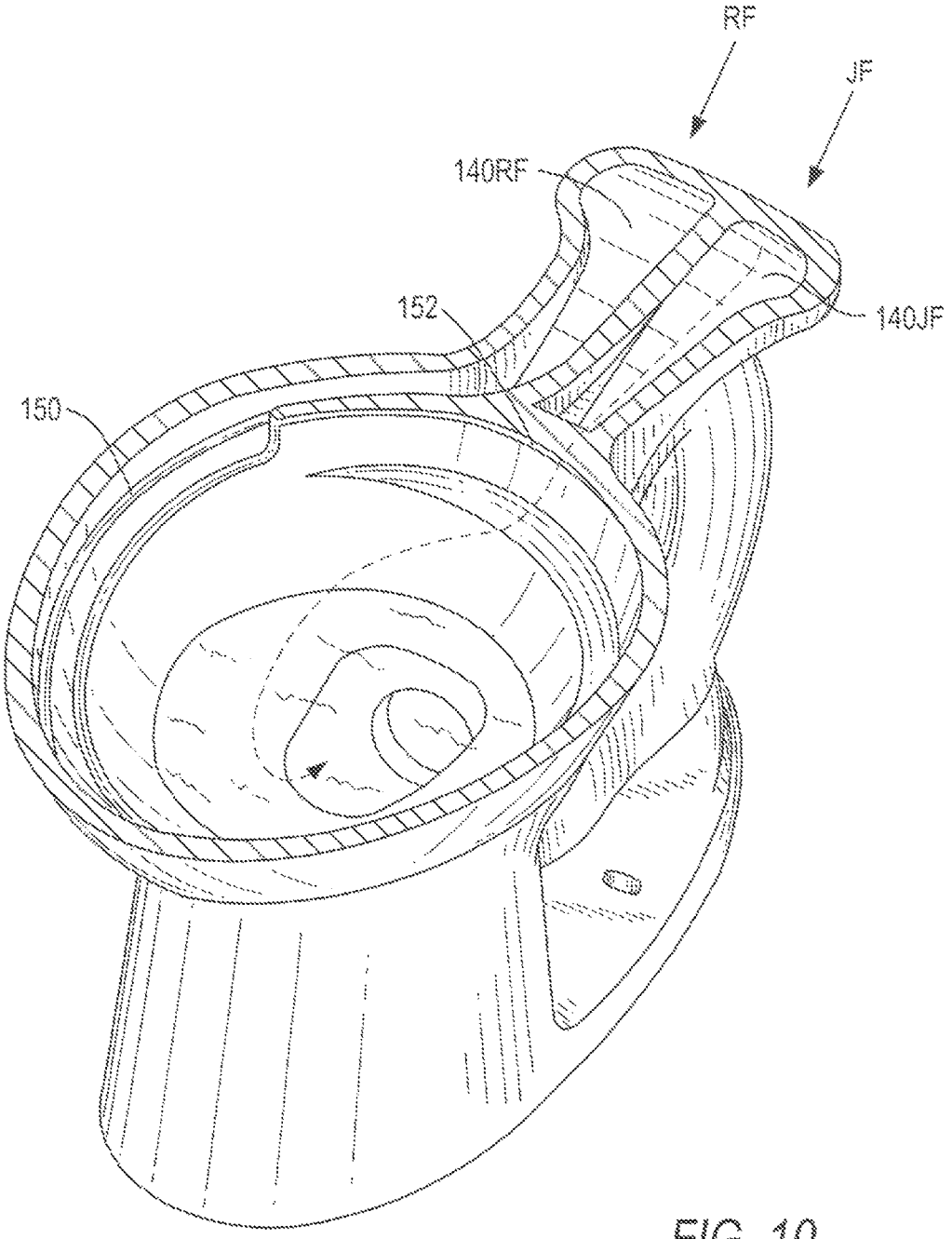
FIG. 10 shows a perspective, cut-away view of a primed siphonic flush toilet, in accordance with various embodiments of the invention.

For instance, a primed siphonic flush toilet with isolated rim and jet channels may be particularly well suited for use with the embodiments disclosed herein because the isolated channels allow the cleaning systems described herein to be positioned in the rim channel. In particular, because compartment 120 may be positioned within the rim channel to allow 100% of the dissolved cleaning agents to flow through the rim outlet ports, this construction can ensure maximum utilization of the cleaning agent by avoiding its direct injection into the entrance of the trapway through the jet outlet port. Accordingly, a primed siphonic flush toilet construction can ensure optimal bulk removal waste from the toilet system in combination with optimal efficacy of the cleaning systems described herein. A perspective, cut-away view of a primed siphonic flush toilet in accordance with some embodiments is shown in FIG. 10. According to embodiments of the present invention, compartment 120 may be located within rim flush (RF) channel 140RF such that the cleaning agents are not directed via jet flush (JF) channel 140JF.

RF channel 140RF can inject cleaning agents into bowl 116 via rim outlet port 150 while JF channel 140JF can direct water through bowl outlet port 152. In particular, FIG. 8 depicts water, including dissolved cleaning agents, entering bowl 116 via rim outlet port 150. As the clean water enters bowl 116, the cleaning agents can clean, disinfect, and deodorize most or all of the surface area of bowl 116. As shown in FIG. 10, after flushing is complete, a volume of clean water, including dissolved cleaning agents, remains in bowl 116, providing long-lasting disinfecting and deodorizing effects. While FIG. 8 depicts a primed siphonic flush toilet, isolated rim and jet chambers may be employed in other types of sanitaryware fixtures.

Although non-jetted bowls typically provide lower flushing power and efficiency than other designs, non-jetted bowls may also be well suited for the use with the embodiments disclosed herein due to the fact that all of the dissolved cleaning fluid would be distributed around the rim of the bowl, achieving greater cleaning efficacy.

Furthermore, while the embodiments described herein may be applied to typical jetted bowls, the efficacy and efficiency of the cleaning agent might be somewhat diminished due to the significant portion that would exit the jet outlet and be directed directly towards the trapway entrance and out of the bowl. In fact, using "direct-jetted" construction, as much as 75% of the cleaning agent may be directed to the jet outlet port, much of which is then siphoned directly up the trap and out of the toilet outlet resulting in material waste, diminished efficacy, and frequent tablet replacement.

The embodiments disclosed with respect to FIGS. 1-10 each provides access to waterway 140 of sanitary fixture 110 via compartment 120 directly accessible from deck 114. Alternative embodiments, in which access to waterway 140 is contained within a seat-hinge cover, are disclosed below with respect to FIGS. 11-15. A seat-hinge cover can serve to seal of waterway 140 and compartment 120 from the environment outside of sanitary fixture 110 such that accessibility to waterway 140 and compartment 120 is through the seat-hinge cover, conceal the cleaning product and the various containing components disclosed above from a user of the fixture, and/or provide a mounting point for seat/cover 118. Seat-hinge covers may be used with any of the embodiments disclosed above.

Figure 11:
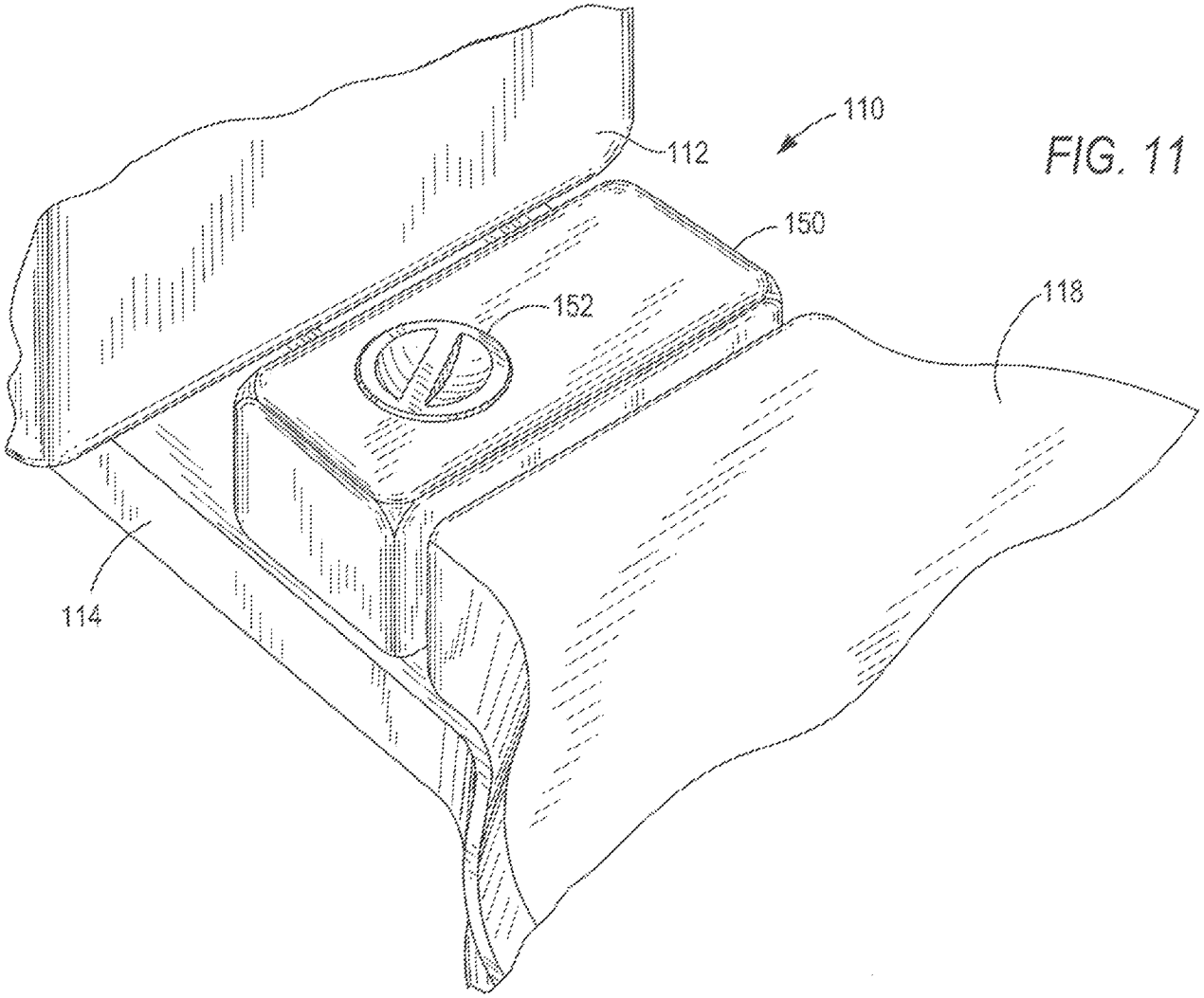
FIG. 11 shows a perspective view of sanitary fixture provided with seat-hinge cover.

FIG. 11 shows a perspective view of sanitary fixture 110 provided with seat-hinge cover 150. Seat-hinge cover 150 can include an aperture, covered by cap 152, which can provide access to compartment 120 for purposes of changing cleaning product 130. In some embodiments, cap 152 may simply cover a hollow cavity within seat-hinge cover 150 such that changing or replenishing cleaning product 130 proceeds as described for each of the embodiments described with respect to FIGS. 1-10.

Alternatively, compartment 120 may be understood to extend from waterway 140, through deck 114 and seat-hinge cover 150, to the aperture in seat-hinge cover 150 sealed off by cap 152. In these embodiments, cap 152 may be functionally similar to cap 124 or 224, cleaning puck 324, or cleaning cup 424. Each of the other components of the above-described embodiments can be lengthened appropriately to traverse the additional height of seat-hinge cover 150 such that cleaning product 130 remains in communication with waterway 140 below deck 114.

Figure 12:
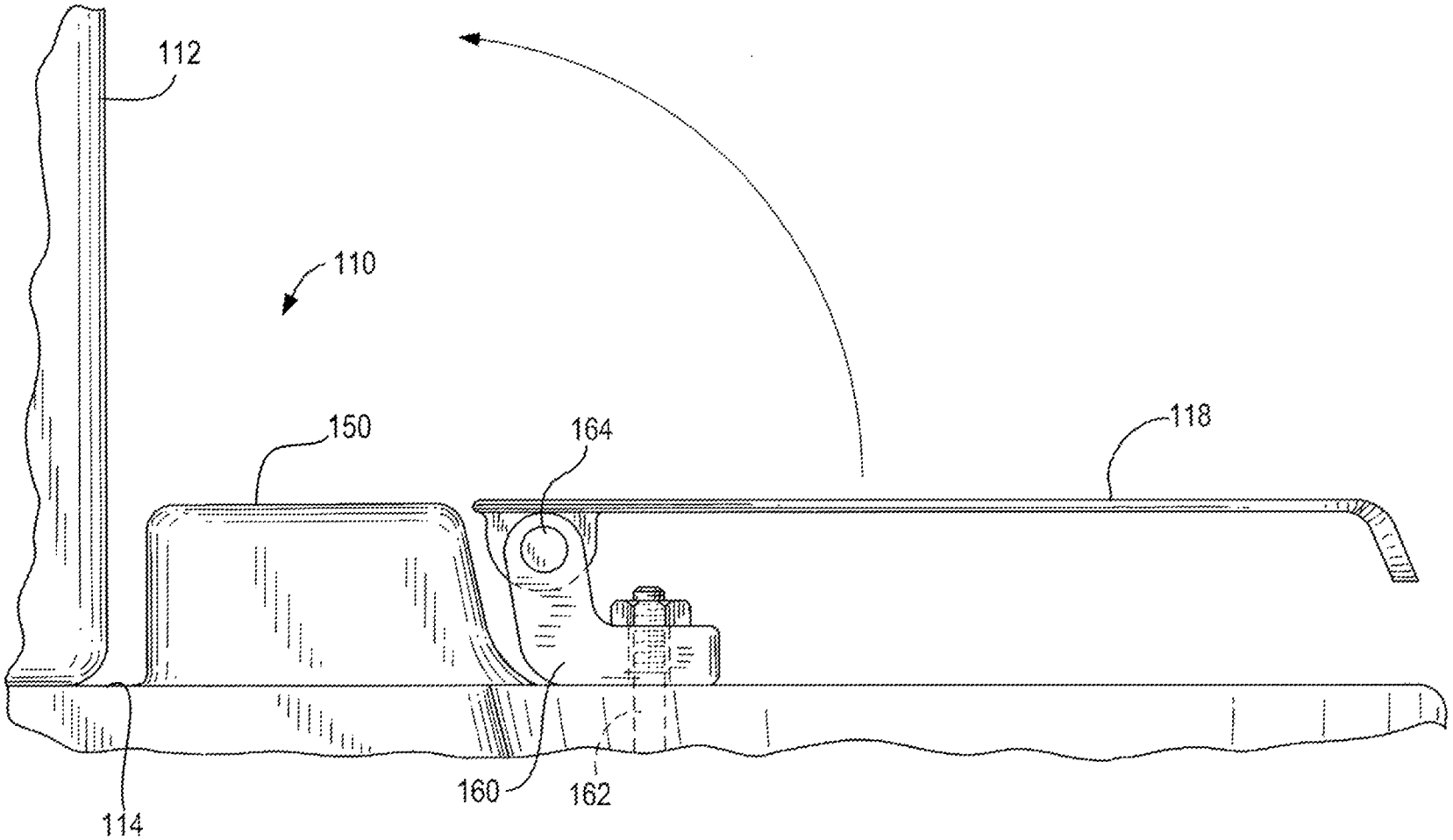
FIG. 12 shows a side elevation view of a seat/cover mounted to a sanitary fixture with an L-bracket, in accordance with various embodiments of the present invention.

FIG. 12 shows a side elevation view of seat/cover 118 mounted to sanitary fixture 110 with L-bracket 160, in accordance with various embodiments of the present invention. L-bracket 160 may raise the pivot point of seat/cover 118, as compared with conventional seat hinges, to avoid interference with seat-hinge cover 150. L-bracket can be mounted to deck 114 using fastener 162 and can include hinge 164 for rotatably coupling seat/cover 118 to sanitary fixture 110.

Figure 13A:
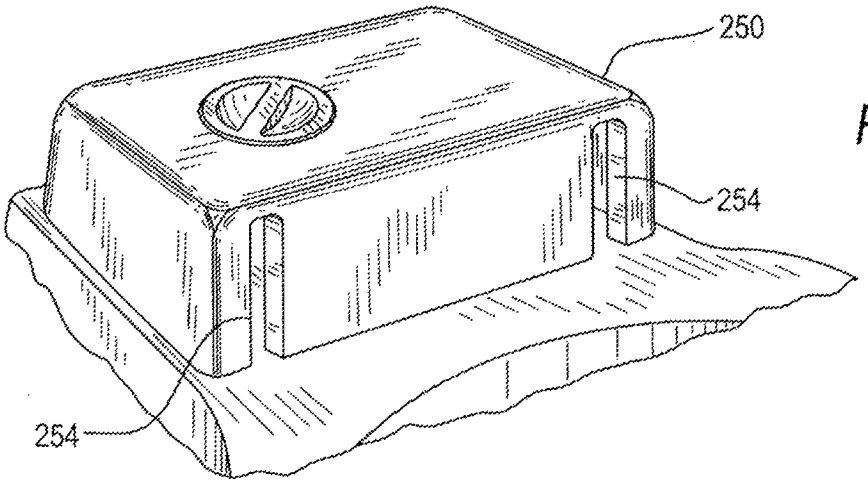
FIGS. 13A and 13B show perspective and side elevation views, respectively, of a seat/cover mounted to a sanitary fixture with a hinge that includes arms and a pivot.
Figure 13B:
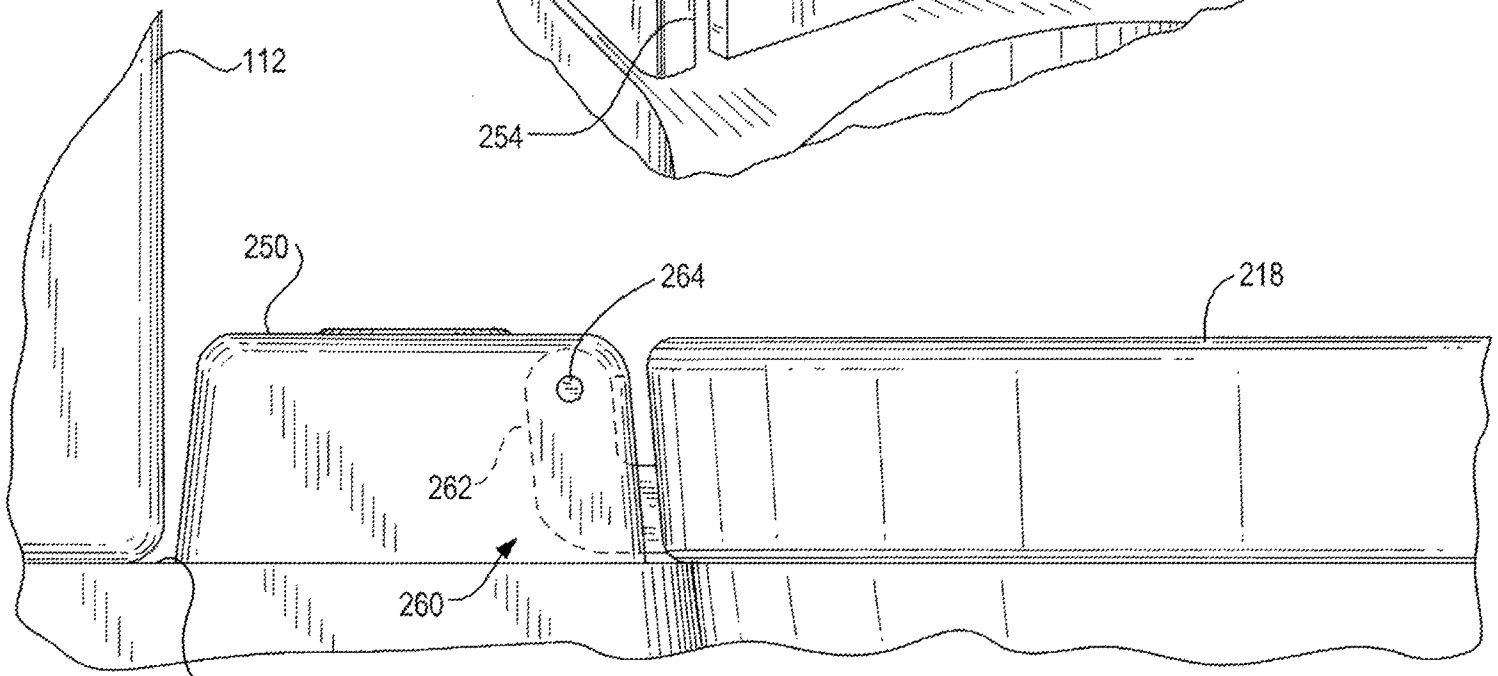

FIGS. 13A and 13B show perspective and side elevation views, respectively of seat/cover 218 mounted to sanitary fixture 110 with hinge 260 that includes arms 262 and pivot 264. Arms 262 can be curved or L-shaped members extending from an edge of seat/cover 218 and into seat-hinge cover 250 to be rotatably coupled to pivot 264. Flapped apertures 254 may be provided in seat-hinge cover 250 to receive arms 263 and to prevent visibility into the interior of seat-hinge cover 250. The flaps that close flapped apertures 254 may be formed from a resilient material, such as silicone or rubber, for example.

FIGS. 14A and 14B show perspective and side elevation views, respectively of seat/cover 318 mounted to sanitary fixture 110 with hinge 360 that includes arms 362 and pivot 364. Arms 362 can be removably inserted into sockets 354 of seat-hinge cover 350 and rotatably couple to pivot 364 outside of seat-hinge cover 350, providing for easy installation and removal of seat/cover 318 for cleaning.

Figure 15A:
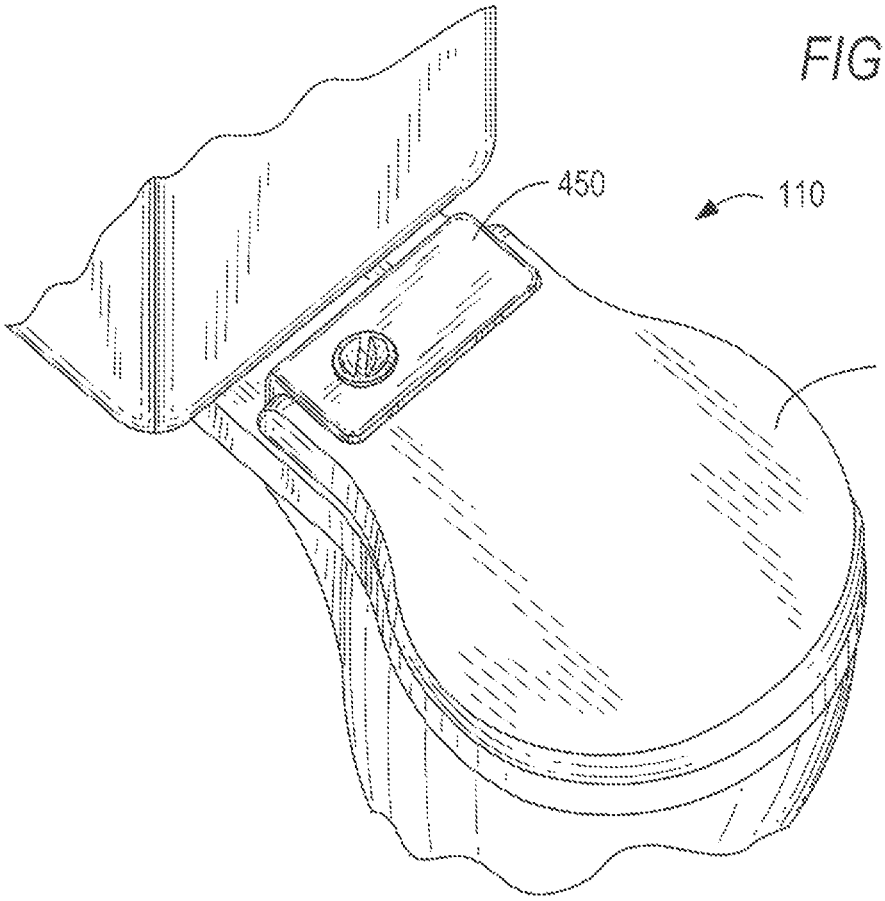
FIGS. 15A and 15B show perspective and cross-sectional views, respectively, of a seat/cover mounted to a sanitary fixture with a hinge that includes a pivot extending from the seat-hinge cover into nested arms of the seat/cover.
Figure 15B:
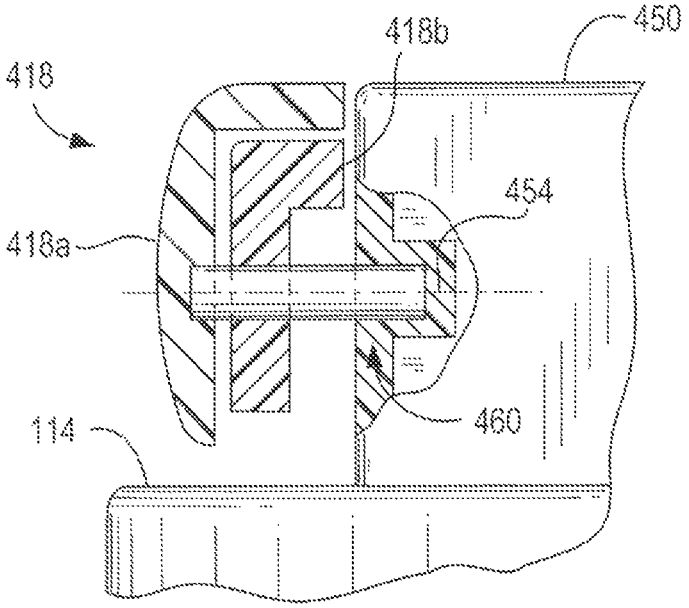

FIGS. 15A and 15B show perspective and cross sectional views, respectively, of seat/cover 418 mounted to sanitary fixture 110 with hinge 460 that includes pivot 454 extending from seat-hinge cover 450 into nested arms of seat/cover 418. In particular, pivot 454 extends through an aperture in an arm of seat 418*b* extending towards deck 114 and into a recess in an arm of cover 414 a extending towards deck 114.

As previously noted, cleaning agents for use with the embodiments disclosed herein may be provided in a water-soluble solid product, such as cleaning product 130, or in liquid form. Embodiments of the present invention that utilize liquid cleaning products will be described below with respect to FIGS. 16-24.

Figure 16:
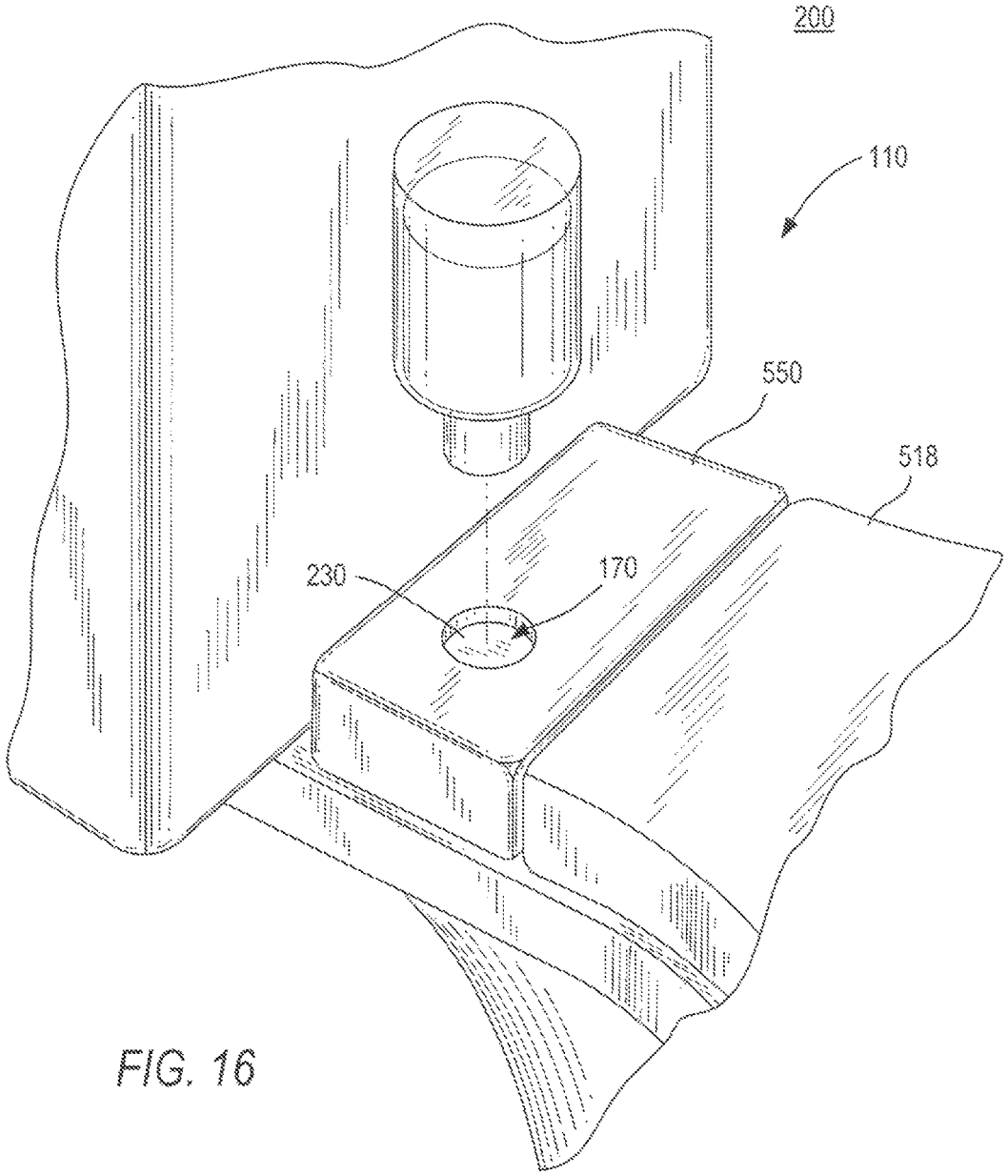
FIG. 16 shows a perspective view of another sanitaryware cleaning system, in accordance with various embodiments of the present invention.

FIG. 16 shows a perspective view of a sanitaryware cleaning system 200, in accordance with various embodiments of the present invention. Sanitaryware cleaning system 200 can include sanitary fixture 110, seat-hinge cover 550, seat/cover 518, and reservoir 170. Seat-hinge cover 550 and seat/cover may each be substantially similar to and, indeed, may be freely interchangeable with any of the seat-hinge covers and seat/cover combinations disclosed above with respect to FIGS. 11-15. The only difference between seat-hinge cover 550 and seat-hinge covers 150, 250, 350, and 450 disclosed above is that seat-hinge cover 550 houses reservoir 170 that receives and/or contains cleaning product 230 (e.g., from a bottle of liquid cleaning material as depicted in FIG. 16). In that respect, reservoir 170 may be likened to compartment 120 of FIGS. 1-15.

Seat-hinge cover 550 can include an aperture in its top surface in fluid communication with reservoir 170 for receiving cleaning product 230. This aperture may be substantially similar to the apertures of seat-hinge covers 150, 250, 350, and 450, and may similarly be closed by a cap such as cap 152. Each of the embodiments disclosed below with respect to FIGS. 17-20 are similar in that they include a reservoir that may be filled with cleaning product 230 via the aperture in seat-hinge cover 550. These embodiments differ in the manner in which cleaning product 230 is released into waterway 140. However, each embodiment may be considered to include a normally-closed valve that opens when water is flowing through waterway 140 and closes once again when water ceases to flow.

FIG. 17 shows a cross-sectional view of seat-hinge cover 550 housing reservoir 270, in accordance with various embodiments of the present invention. Cleaning product 230 may be introduced into reservoir 270 via the method described above. When water flows through waterway 140, arm 274 can be deflected from its neutral position, thereby opening valve 272 and permitting cleaning product to flow from reservoir 270 into waterway 114 and thereafter into bowl 116. Once water stops flowing through waterway 114, arm 274 returns to its neutral position, thereby closing valve 272.

FIG. 18 shows a cross-sectional view of seat-hinge cover 550 housing reservoir 370, in accordance with various embodiments of the present invention. The embodiment depicted in FIG. 18 includes arm 374, which is operationally similar to arm 274 of FIG. 17. However, rather than manually opening a valve, arm 374 activates powered valve 372, which may be implemented, for example, as a battery-powered solenoid valve. FIG. 18 depicts powered valve being powered by batteries 376; however, it should be understood that any suitable power source can be employed to power powered valve 372.

Figure 19:
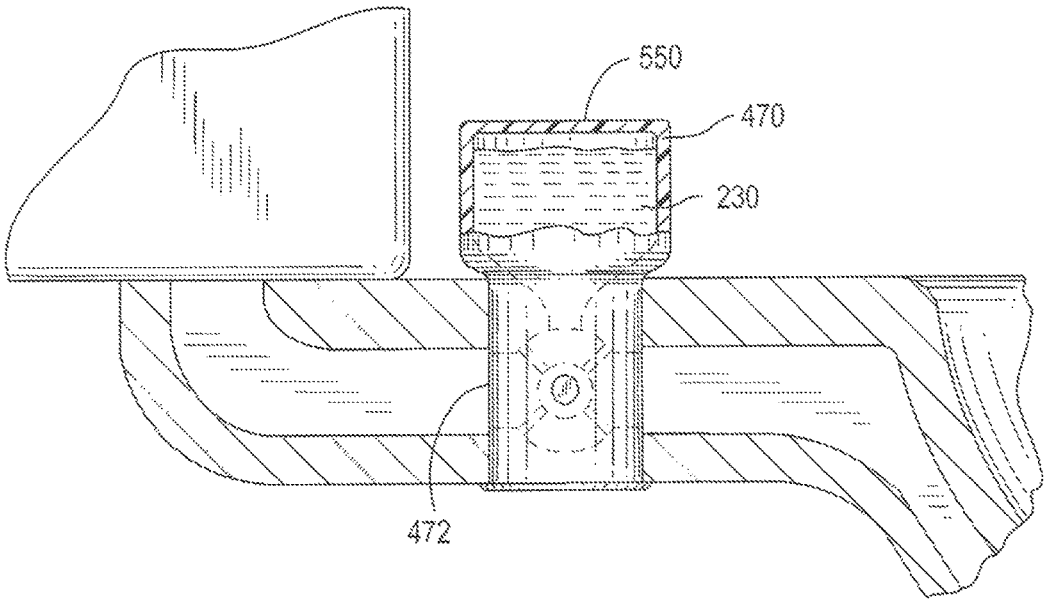
FIG. 19 shows a cross-sectional view of a seat-hinge cover housing yet another reservoir, in accordance with various embodiments of the present invention.

FIG. 19 shows a cross-sectional view of seat-hinge cover 550 housing reservoir 470, in accordance with various embodiments of the present invention. Reservoir 470 may be in fluid communication with waterway 140 via a compartment 472 that houses a pinwheel mechanism. The pinwheel mechanism may be configured to receive a measured amount of cleaning product 230 while in a rest position when water is not flowing in waterway 140. Once water begins to flow in waterway 140, the water can spin the pinwheel about a pivot point, thereby introducing the cleaning product into the water flowing toward bowl 116. The pinwheel can continue to spin, introducing more cleaning product 230 into the bowl until the flow of water through waterway 140 ceases.

Figure 20:
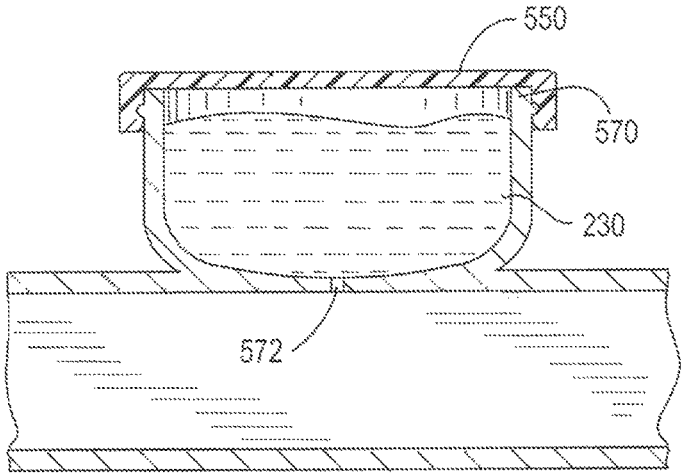
FIG. 20 shows a cross-sectional view of seat-hinge cover housing still another reservoir, in accordance with various embodiments of the present invention.

FIG. 20 shows a cross-sectional view of seat-hinge cover 550 housing reservoir 570, in accordance with various embodiments of the present invention. Reservoir 570 may be in fluid communication with waterway 114 via a capillary tube 572. When water begins to flow through waterway 140, the change in pressure can draw cleaning product 230 through capillary tube 572 and into the water flowing toward bowl 116. The amount of cleaning product 230 dispensed with each flush may be varied, for example, based on the diameter of capillary tube 572.

FIGS. 21A and 21B show perspective and cross sectional views of a sanitaryware cleaning system 300, in accordance with various embodiments of the present invention. Sanitaryware cleaning system 300 can include sanitary fixture 110, seat/cover 618, and reservoir 670. Sanitaryware cleaning system 300 may be substantially similar to the embodiments disclosed above with respect to FIGS. 16-20 with the exception that the reservoir is located above the seat/cover rather than in a seat-hinge cover. Indeed cleaning produce 230 may be introduced into waterway 140 using any of the mechanisms depicted in FIGS. 17-20 adapted for the slightly altered flow path of cleaning product 230. As with seat-hinge cover 550, cleaning product 230 may be introduced into an aperture formed in the top of seat/cover 618 that is in fluid communication with reservoir 670.

Figure 22:
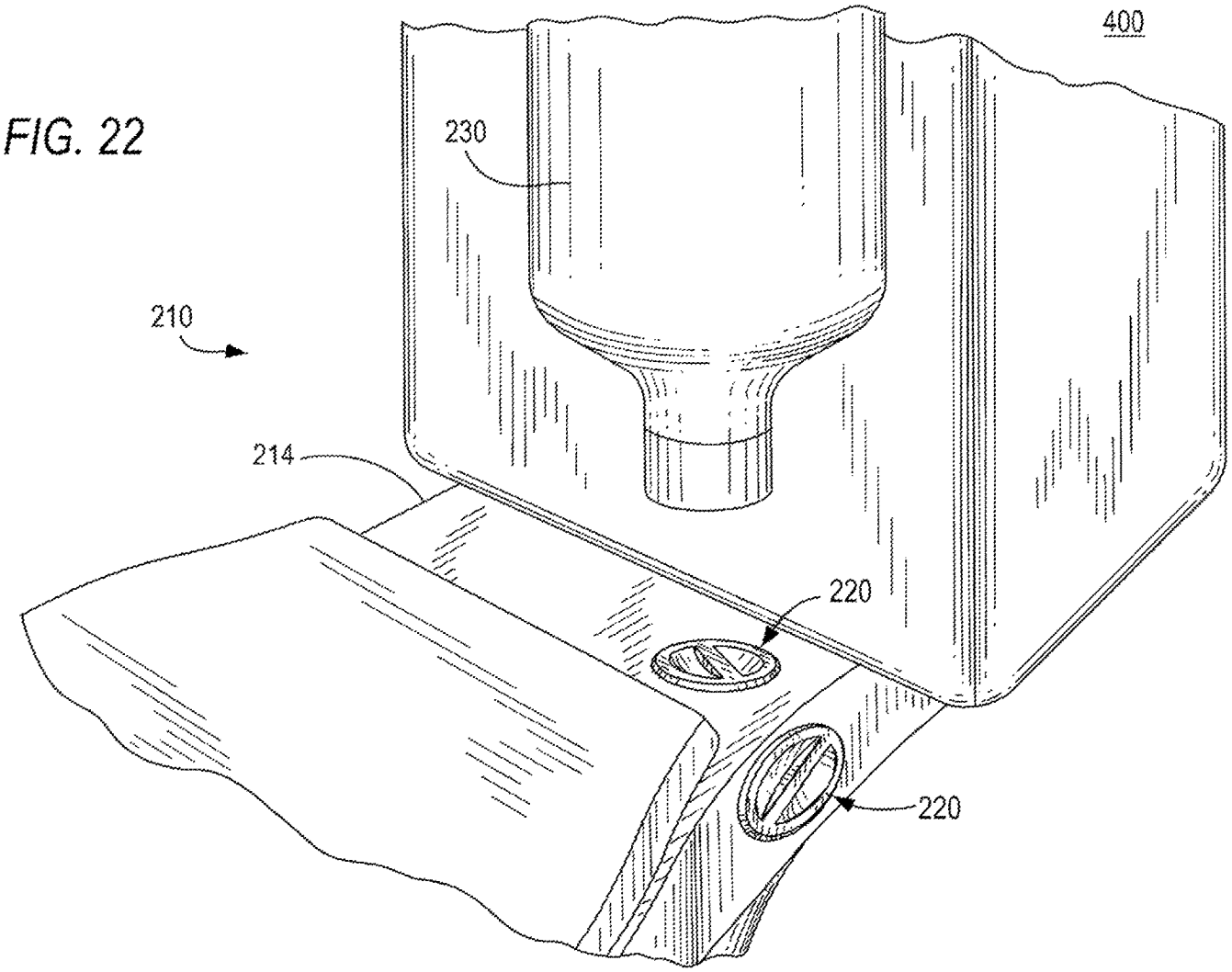
FIG. 22 shows a perspective view of another sanitaryware cleaning system, in accordance with various embodiments of the present invention.

FIG. 22 shows a perspective view of a sanitaryware cleaning system 400, in accordance with various embodiments of the present invention. Sanitaryware cleaning system 400 can include sanitary fixture 210, which may be substantially similar to sanitary fixture 110, with the exception that compartment 220 (akin to compartment 120 of FIG. 1) may be custom sized and shaped to receive a bottle of cleaning product 230. Thus, cleaning product may be received directly into a reservoir located under deck 214 of sanitary fixture 210. Once cleaning product 230 is introduced into the reservoir, it can be injected into waterway 140 using any of the mechanisms depicted in FIGS. 17-20 adapted for the slightly altered flow path of cleaning product 230. Sanitary fixture 210 may additionally or alternatively include a compartment formed in a side-facing surface of deck 214 in fluid communication with the reservoir.

Figure 23B:
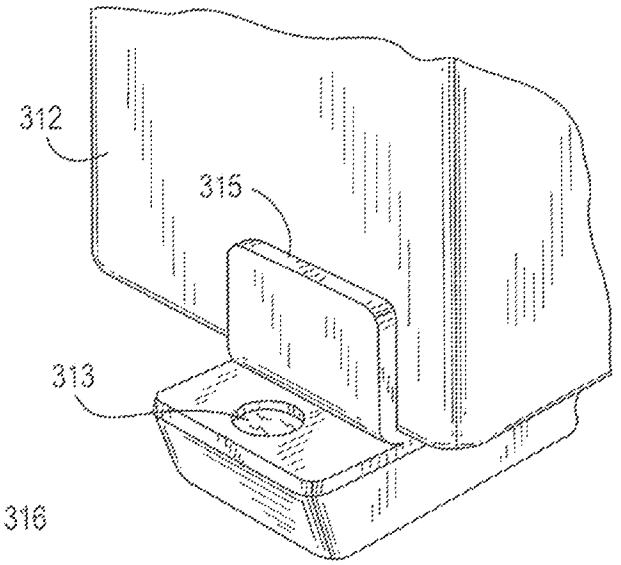
FIGS. 23A and 23B show perspective and detailed perspective views, respectively, of yet another sanitaryware cleaning system, in accordance with various embodiments of the present invention.
Figure 23A:
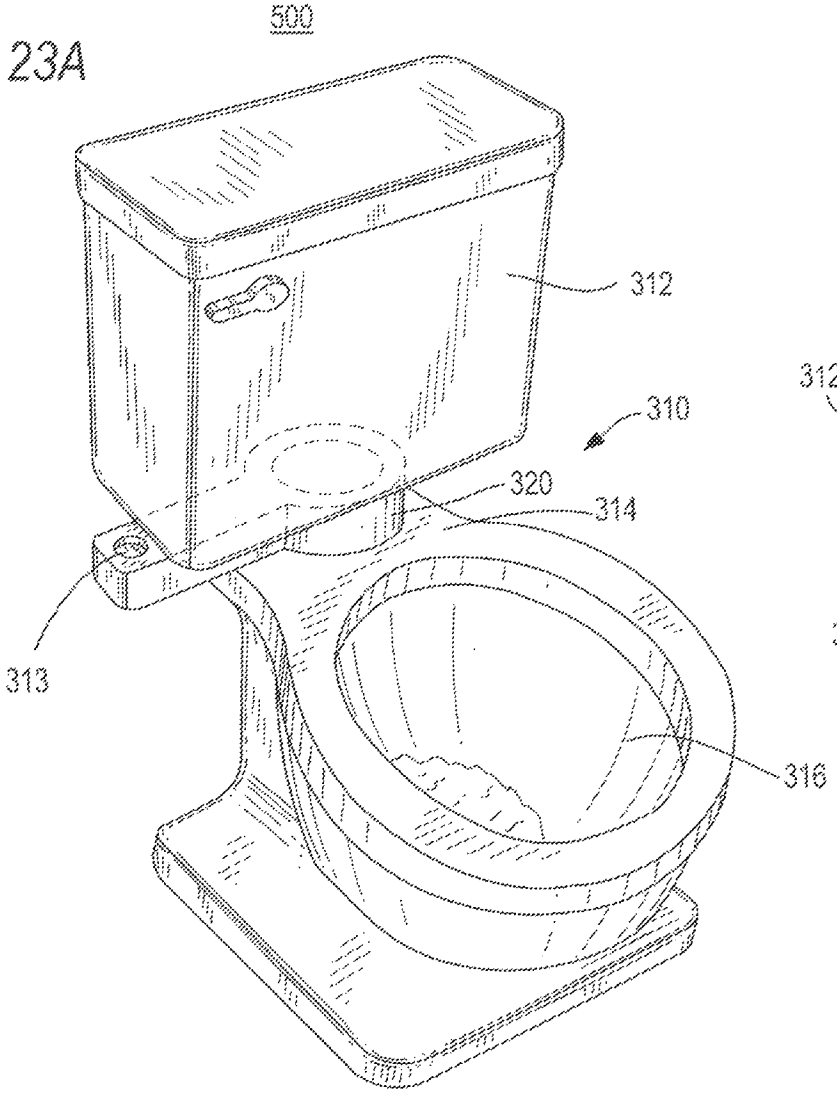

FIGS. 23A and 23B show perspective and detailed perspective views, respectively, of sanitaryware cleaning system 500, in accordance with various embodiments of the present invention. Sanitaryware cleaning system 500 can include sanitary fixture 310, which may be similar to sanitary fixture 210, with the exception that compartment 320 may be accessible from a fill port 313 located away from deck 314 and bowl 316. As depicted in FIG. 23A, for example, fill port 313 may be located under and extending away from tank 312. Cleaning product 230 may be introduced into the fill port, which may be in fluid communication with a reservoir that may be substantially similar to the reservoir of sanitary fixture 210. Once cleaning product 230 is introduced into the reservoir, it can be injected into waterway 140 using any of the mechanisms depicted in FIGS. 17-20 adapted for the slightly altered flow path of cleaning product 230. As illustrated in FIG. 23B, fill port 313 may be accessible via a flap 315 that closes fill port 313 when not in use.

Figure 24:
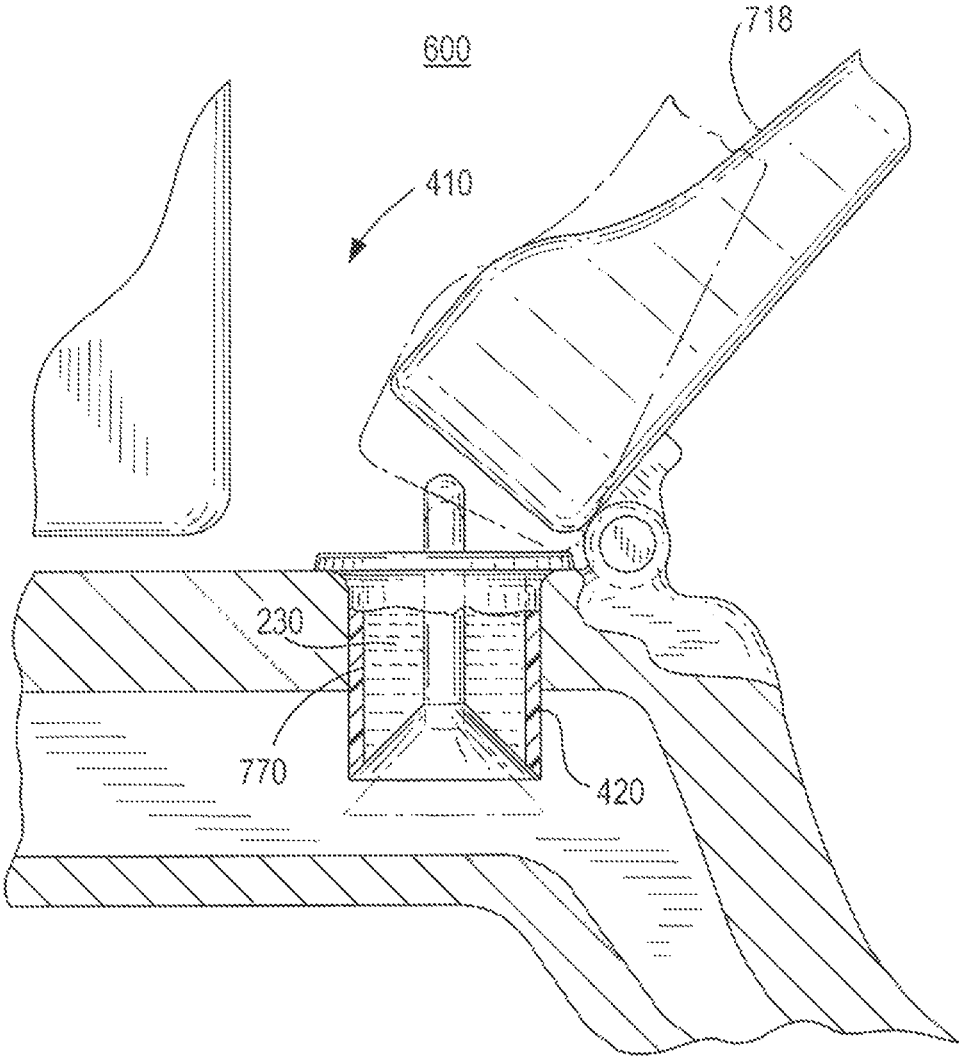
FIG. 24 shows a cross-sectional view of still another sanitaryware cleaning system, in accordance with various embodiments of the present invention.

FIG. 24 shows a cutaway view of sanitaryware cleaning system 600, in accordance with various embodiments of the present invention. Sanitaryware cleaning system 600 can include sanitary fixture 410, which may be similar to sanitary fixture 210, with the exception that compartment 420 may be plunger activated by seat/cover 718. That is, cleaning product 230 may be introduced into reservoir 770, which may be substantially similar to the reservoirs of FIGS. 22 and 23, and a measured amount of cleaning product 230 may be released into waterway 414 located below reservoir 370 when contacted by seat/cover 718.

It will thus be seen that the aspects, features and advantages made apparent from the foregoing are efficiently attained and, since certain changes may be made without departing from the spirit and scope of the invention, it is intended that all matter contained herein shall be interpreted as illustrative and not in a limiting sense.

What is claimed is:

1. A sanitary fixture, comprising:
a tank, a deck, and a bowl;
a waterway extending between the tank and the bowl;
a hole in the deck;
a compartment extending through the deck into the waterway; and
a seat-hinge cover for covering a hinge of a toilet seat and for housing the compartment, the seat-hinge cover comprising an aperture formed in a top surface, the seat-hinge cover coupled to a top surface of the deck between the tank and the bowl,
wherein the compartment is in fluid communication with the waterway through the hole in the deck.

2. The sanitary fixture of claim 1, further comprising:
a cleaning product located in the compartment.

3. The sanitary fixture of claim 2, wherein the cleaning product comprises one of a water-soluble solid product and a liquid cleaning product.

4. The sanitary fixture of claim 1, further comprising a cap sealing the compartment off from the outside environment.

5. The sanitary fixture of claim 1, wherein the hole in the deck extends from a top surface of the deck and at least partially into the waterway.

6. The sanitary fixture of claim 1, further comprising:
a basket situated in the compartment for maintaining a cleaning product at least partially in the waterway.

7. The sanitary fixture of claim 6, wherein the basket includes at least one of a plurality of apertures to allow water to flow from the tank, through the basket, and into the bowl.

8. The sanitary fixture of claim 6, wherein the basket is fully retained within the compartment.

9. The sanitary fixture of claim 6, wherein the basket comprises an annular lip configured to one of:
rest atop a top surface of the deck; and
rest below a top surface of the deck.

10. The sanitary fixture of claim 6, wherein the basket is configured to inject cleaning agents into the bowl periodically.

11. The sanitary fixture of claim 10, wherein the basket comprises:
an inner shell having a plurality of apertures;
an outer shell having a plurality of apertures;
a waterwheel coupled to one of the inner shell and the outer shell, the waterwheel configured to rotate about an axis extending along longitudinal axes of the inner shell and the outer shell when water flows through the waterway; and
a cap coupled to the other one of the inner shell and the outer shell, wherein the cap rotatably fixes the other one of the inner shell and the outer shell.

12. The sanitary fixture of claim 1, further comprising a cleaning puck situated in the compartment, the cleaning puck comprising:
a hollow cavity in fluid communication with the waterway; and
a cleaning product located in the hollow cavity.

13. The sanitary fixture of claim 1, further comprising a cleaning cup situated in the compartment, the cleaning cup comprising:
a cap portion; and
a basket portion, the basket portion comprising a plurality of apertures, a hollow cavity, and a cleaning product retained in the hollow cavity.

14. The sanitary fixture of claim 13, further comprising an sleeve comprising:
an interior annular perimeter configured to mate with an exterior annular perimeter of the basket portion of the cleaning cup; and
an exterior annular perimeter configured to be received proximate to an annular wall of the compartment.

15. The sanitary fixture of claim 14, further comprising:
a sealing sleeve formed from a resilient material located between the annular wall of the compartment and the exterior annular perimeter of the sleeve for sealing the compartment from the outside environment.

16. A sanitary fixture, comprising:
a tank, a deck, and a bowl;
a waterway extending between the tank and the bowl;
a reservoir for receiving a liquid cleaning product in fluid communication with the waterway through an aperture in the deck; and
a seat-hinge cover for covering a hinge of a toilet seat, the seat-hinge cover comprising an aperture formed in a top surface, the seat-hinge cover housing the reservoir.

17. The sanitary fixture of claim 16, wherein the reservoir is located below a top surface of the deck.

18. The sanitary fixture of claim 16, wherein the reservoir is fluidly connected to the waterway via a normally-closed valve that opens when water flows through the waterway.

19. The sanitary fixture of claim 1, further comprising a hinge configured to be attached to the seat-hinge cover.

20. The sanitary fixture of claim 1, wherein the seat-hinge cover covers the compartment.

21. The sanitary fixture of claim 1, wherein the compartment is aligned with the aperture in the seat-hinge cover.

* * * * *